US008872614B2

(12) United States Patent
Nishiura et al.

(10) Patent No.: US 8,872,614 B2
(45) Date of Patent: Oct. 28, 2014

(54) TRANSFORMER

(75) Inventors: Ryuichi Nishiura, Chiyoda-ku (JP); Yasuo Fujiwara, Chiyoda-ku (JP); Yoshinori Shimizu, Chiyoda-ku (JP); Tetsuya Matsuda, Chiyoda-ku (JP); Takeshi Imura, Chiyoda-ku (JP); Kazuaki Aono, Chiyoda-ku (JP); Hiroyuki Akita, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 86 days.

(21) Appl. No.: 13/392,251

(22) PCT Filed: Oct. 19, 2010

(86) PCT No.: PCT/JP2010/068334

§ 371 (c)(1),
(2), (4) Date: Feb. 24, 2012

(87) PCT Pub. No.: WO2011/062018

PCT Pub. Date: May 26, 2011

(65) Prior Publication Data

US 2012/0146760 A1 Jun. 14, 2012

(30) Foreign Application Priority Data

Nov. 20, 2009 (JP) ..... 2009-265368

(51) Int. Cl.
*H01F 27/24* (2006.01)

(52) U.S. Cl.
USPC ..... 336/234

(58) Field of Classification Search
USPC ..... 336/212, 233–234, 178, 84 R, 84 M
See application file for complete search history.

(56) References Cited

FOREIGN PATENT DOCUMENTS

| | | | |
|---|---|---|---|
| JP | 49-61620 | | 6/1974 |
| JP | 54102518 A | * | 8/1979 |
| JP | 60-7109 A | | 1/1985 |
| JP | 60-57115 U | | 4/1985 |
| JP | 60-81618 U | | 6/1985 |
| JP | 61-146926 U | | 9/1986 |
| JP | 62-32518 U | | 2/1987 |
| JP | 63-20810 A | | 1/1988 |
| JP | 63-200312 U | | 12/1988 |

(Continued)

OTHER PUBLICATIONS

International Search Report (PCT/ISA/210) issued on Jan. 11, 2011, by Japanese Patent Office as the International Searching Authority for International Application No. PCT/JP2010/068334.

(Continued)

*Primary Examiner* — Tuyen Nguyen
(74) *Attorney, Agent, or Firm* — Buchanan Ingersoll & Rooney PC

(57) ABSTRACT

A transformer includes a leg iron core including a plurality of magnetic sheets stacked in one direction (Z axis direction), and a coil wound around the leg iron core. A slit is formed in at least a magnetic sheet which faces an inner peripheral surface of the coil in a stacking direction of the plurality of magnetic sheets, of the plurality of magnetic sheets. Since eddy current is divided by the slit, eddy current density can be reduced. By reducing the eddy current density, loss density in an iron core can be reduced. By reducing the loss density in the iron core, loss in the transformer can be reduced.

11 Claims, 23 Drawing Sheets

(56) References Cited

FOREIGN PATENT DOCUMENTS

| | | | | |
|---|---|---|---|---|
| JP | 1-259514 | A | | 10/1989 |
| JP | 2-91324 | U | | 7/1990 |
| JP | 03055810 | A | * | 3/1991 |
| JP | 3-147307 | A | | 6/1991 |
| JP | 4-74403 | A | | 3/1992 |
| JP | 4-137714 | A | | 5/1992 |
| JP | 10-116741 | A | | 5/1998 |
| JP | 2000-114063 | A | | 4/2000 |
| JP | 2000-114064 | A | | 4/2000 |
| JP | 2001-35733 | A | | 2/2001 |
| JP | 2003-203813 | A | | 7/2003 |
| JP | 2003-347134 | A | | 12/2003 |
| JP | 2005-150413 | A | | 6/2005 |

OTHER PUBLICATIONS

Office Action (Notice of Grounds of Rejection) mailed by the Japanese Patent Office on May 7, 2013, in the corresponding Japanese Patent Application No. 2011-220841, and an English Translation thereof. (5 pages).

* cited by examiner

TRANSFORMER

TECHNICAL FIELD

The present invention relates to a transformer, and particularly to a structure of an iron core included in a transformer.

BACKGROUND ART

Generally, an iron core of a large-capacity transformer has a structure formed by stacking thin-sheet type magnetic bodies (for example, electromagnetic steel sheets, amorphous sheets, or the like). For example, PTL 1 (Japanese Utility Model Laying-Open No. 60-81618) discloses composing an iron core by bending a band-like ferromagnetic sheet, in order to facilitate an operation of assembling the iron core. At a bent portion of the ferromagnetic sheet, a punched hole or a cutout hole is formed with small connecting portions being left in a width direction.

On the other hand, in order to improve efficiency of a transformer, it is required to reduce loss in the transformer. The loss in the transformer includes eddy current loss due to leaked magnetic flux from a coil. Techniques for reducing eddy current loss have been proposed in the past.

For example, PTL 2 (Japanese Patent Laying-Open No. 2003-347134) and PTL 3 (Japanese Patent Laying-Open No. 1-259514) each disclose a structure of an iron core for reducing eddy current loss. Specifically, PTL 2 discloses forming slits in a horizontal direction in both of upper and lower ring yokes sandwiching a stacked block iron core. PTL 3 discloses forming slits in yokes provided at both ends of a main iron core with gaps, along magnetic flux density distribution.

Further, for example, PTL 4 to PTL 6 (Japanese Utility Model Laying-Open No. 60-57115, Japanese Patent Laying-Open No. 10-116741, and Japanese Patent Laying-Open No. 2001-35733) each disclose a structure of an electromagnetic shield attached to an inner wall surface of a tank for accommodating a transformer. For example, PTL 4 (Japanese Utility Model Laying-Open No. 60-57115) discloses a shield sheet having a plurality of slits or grooves formed therein. The slits or grooves are formed on both upper and lower end sides of the shield sheet serving as an inflow portion and an outflow portion for magnetic flux to have a depth deeper than a permeation depth of the magnetic flux, and extend along a width direction of the shield sheet.

For example, PTL 5 (Japanese Patent Laying-Open No. 10-116741) discloses an electromagnetic shield formed by stacking silicon steel strips. At least one slit is formed in a surface of the silicon steel strips, along a longitudinal direction thereof. For example, PTL 6 (Japanese Patent Laying-Open No. 2001-35733) discloses an electromagnetic shield formed by stacking magnetic bodies inside a tank. For example, a slit is provided only on a surface side of the electromagnetic shield.

PTL 7 (Japanese Utility Model Laying-Open No. 62-32518) discloses an electromagnetic shield member formed to cover upper, lower, and side surfaces of windings. A plurality of slits are formed in the electromagnetic shield member. PTL 8 (Japanese Patent Laying-Open No. 2003-203813) discloses forming a slit in a magnetic conductor provided at least one of upper and lower surfaces of a planar conductor coil.

CITATION LIST

Patent Literature

PTL 1: Japanese Utility Model Laying-Open No. 60-81618

PTL 2: Japanese Patent Laying-Open No. 2003-347134

PTL 3: Japanese Patent Laying-Open No. 1-259514

PTL 4: Japanese Utility Model Laying-Open No. 60-57115

PTL 5: Japanese Patent Laying-Open No. 10-116741

PTL 6: Japanese Patent Laying-Open No. 2001-35733

PTL 7: Japanese Utility Model Laying-Open No. 62-32518

PTL 8: Japanese Patent Laying-Open No. 2003-203813

SUMMARY OF INVENTION

Technical Problem

As described above, various techniques for reducing eddy current loss in a transformer have been proposed in the past. However, in order to improve efficiency of a transformer, it is required to reduce loss in the transformer as much as possible. Therefore, the techniques for reducing loss in a transformer still have room for improvement.

The present invention has been made to solve the aforementioned problem, and one object of the present invention is to provide a structure of an iron core capable of reducing loss in a transformer.

Solution to Problem

In summary, the present invention is directed to a transformer, including an iron core including a plurality of magnetic sheets stacked in one direction, and a coil wound around the iron core. A slit is formed in at least a magnetic sheet which faces an inner peripheral surface of the coil in a stacking direction of the plurality of magnetic sheets, of the plurality of magnetic sheets.

Advantageous Effects of Invention

According to the present invention, eddy current loss in the iron core can be reduced, and thus loss in the transformer can be reduced.

DESCRIPTION OF EMBODIMENTS

Figure 1A:
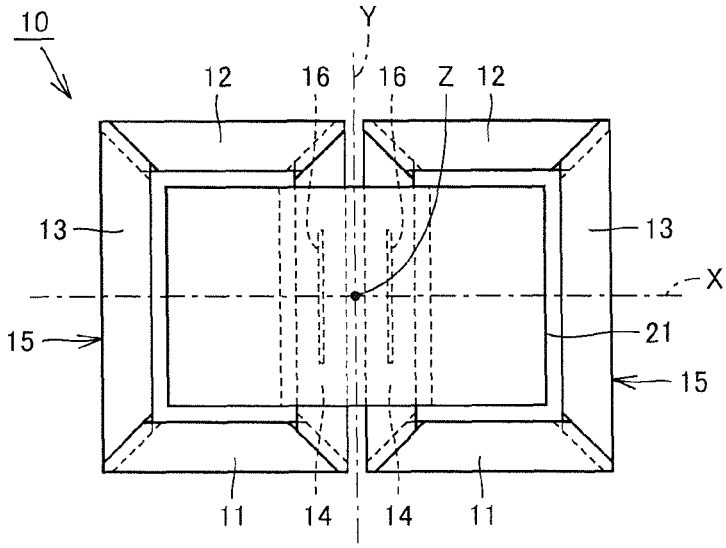
FIG. 1A is a view of a transformer in accordance with Embodiment 1 of the present invention when viewed from a stacking direction of a plurality of magnetic sheets constituting an iron core.

Hereinafter, embodiments of the present invention will be described in detail with reference to the drawings. It is to be noted that identical or corresponding parts in the drawings will be designated by the same reference numerals, and the description thereof will not be repeated.

A transformer in accordance with the embodiments of the present invention is used, for example, for power transmission and distribution in a substation. However, the transformer of the present invention is not limited to the one for power transmission and distribution, and is widely applicable.

Embodiment 1

Figure 1B:
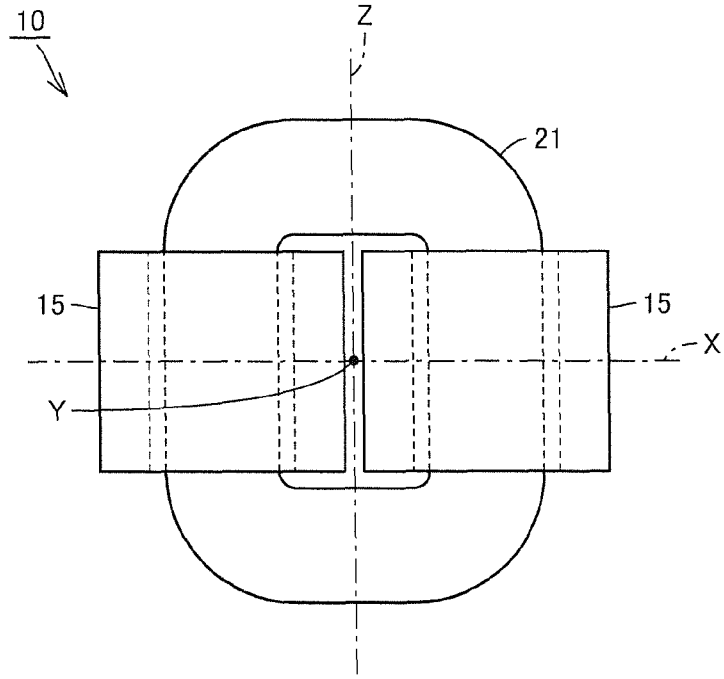
FIG. 1B is a view of the transformer in accordance with Embodiment 1 of the present invention when viewed from a direction of a winding axis of a coil.

FIGS. 1A and 1B are views schematically showing a structure of a transformer in accordance with Embodiment 1 of the present invention. FIG. 1A is a view of the transformer in accordance with Embodiment 1 of the present invention when viewed from a stacking direction of a plurality of magnetic sheets constituting an iron core. FIG. 1B is a view of the transformer in accordance with Embodiment 1 of the present invention when viewed from a direction of a winding axis of a coil.

Referring to FIGS. 1A and 1B, a transformer 10 includes two iron cores 15 and a coil 21. Iron core 15 has an annular shape forming a closed magnetic circuit. Specifically, iron core 15 has a substantially rectangular frame shape.

Iron core 15 includes a pair of yoke iron cores 11, 12, and a pair of leg iron cores 13, 14. Yoke iron core 11 and yoke iron core 12 are arranged in parallel with an interval interposed therebetween, and leg iron core 13 and leg iron core 14 are arranged in parallel with an interval interposed therebetween. One ends of yoke iron cores 11, 12 are joined by leg iron core 13, and the other ends of yoke iron cores 11, 12 are joined by leg iron core 14. Each of yoke iron cores 11, 12 and leg iron cores 13, 14 has a shape extending like a band along a surrounding direction of iron core 15 having an annular shape.

Two iron cores 15 are arranged such that leg iron cores 14 are adjacent to each other. The X axis in FIG. 1A indicates a direction in which two iron cores 15 are arranged. Coil 21 is wound around two leg iron cores 14 arranged adjacent to each other in the X-axis direction. Although not shown, coil 21 includes a high-voltage winding and a low-voltage winding having a common central axis. The Y axis in FIG. 1B indicates the central axis (winding axis) of coil 21.

Each of yoke iron cores 11, 12 and leg iron cores 13, 14 has a stacked structure in which a plurality of thin-sheet type magnetic bodies are stacked in layers. Hereinafter, a thin-sheet type magnetic body will be referred to as a "magnetic sheet". In the embodiments of the present invention, an electromagnetic steel sheet, more specifically a directional steel sheet is applied as a magnetic sheet constituting yoke iron cores 11, 12 and leg iron cores 13, 14.

The Z axis shown in FIGS. 1A and 1B indicates the stacking direction of the plurality of magnetic sheets. The X axis, Y axis, and Z axis shown in FIGS. 1A and 1B are axes perpendicular to each other. Since the X axis, Y axis, and Z axis shown in the drawings described later also satisfy the above relationship, the description of the X axis, Y axis, and Z axis will not be repeated below.

In the embodiments of the present invention, a slit 16 is formed in a surface of at least a magnetic sheet which faces an inner peripheral surface of coil 21, of the plurality of magnetic sheets constituting leg iron core 14. It is to be noted that, although FIG. 1A shows a configuration of transformer 10 viewed from one side along the stacking direction of the plurality of magnetic sheets, a configuration of transformer 10 viewed from the opposite side is also identical to the configuration in FIG. 1A. That is, slits 16 are formed in magnetic sheets at both ends of the plurality of magnetic sheets stacked along the Z-axis direction.

Figure 2A:
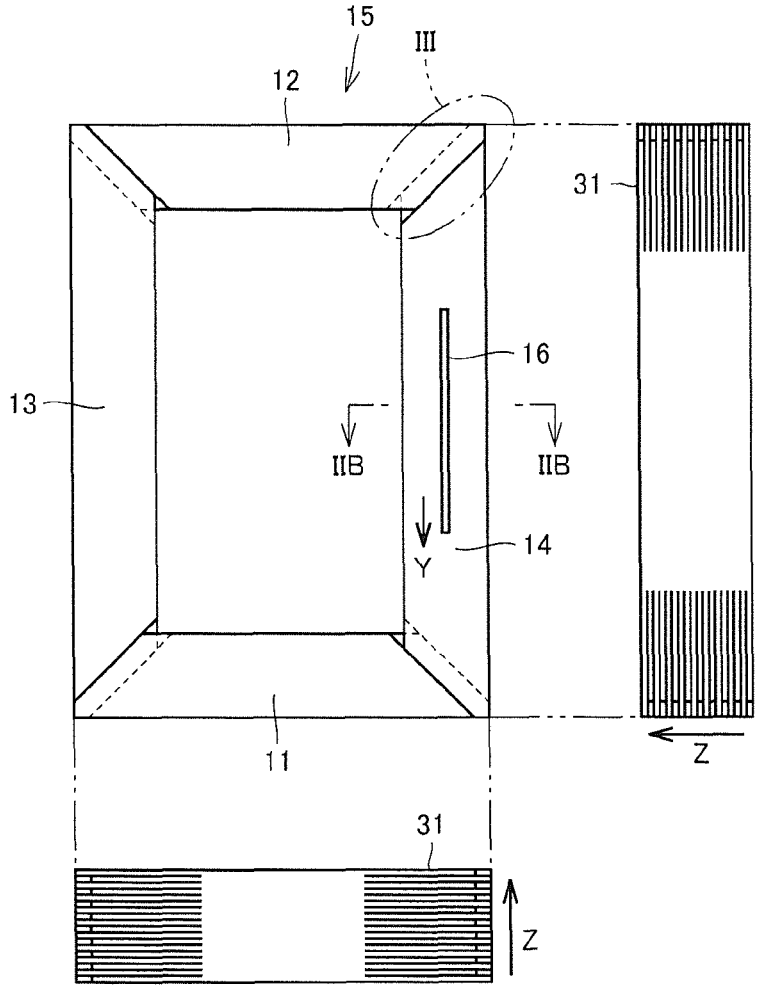
FIG. 2A is a view showing the iron core when viewed along a Z direction shown in FIGS. 1A and 1B.
Figure 2B:
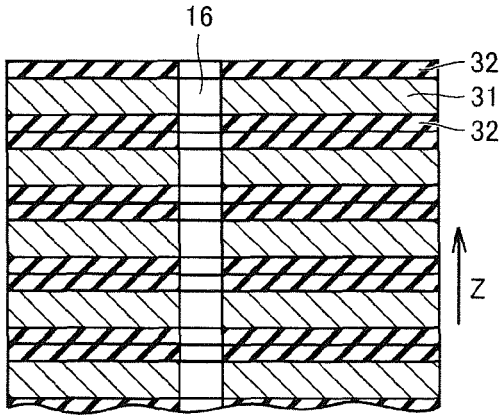
FIG. 2B is a view showing a cross section along IIB-IIB in FIG. 2A.

FIGS. 2A and 2B are plan views of the iron core shown in FIGS. 1A and 1B. FIG. 2A is a view showing the iron core when viewed along a Z direction shown in FIGS. 1A and 1B. FIG. 2B is a view showing a cross section along IIB-IIB in FIG. 2A.

Referring to FIGS. 2A and 2B, a Y direction and a Z direction correspond to the Y-axis direction and the Z-axis direction shown in FIG. 1, respectively. Each of yoke iron cores 11, 12 and leg iron cores 13, 14 includes a plurality of electromagnetic steel sheets 31 stacked in the Z direction. A main surface of electromagnetic steel sheet 31 constituting leg iron core 14 extends along the Y direction.

Slit 16 is formed in at least an electromagnetic steel sheet which faces the inner peripheral surface of coil 21, of the plurality of electromagnetic steel sheets constituting leg iron core 14. Since slit 16 is formed along an extending direction of the main surface of electromagnetic steel sheet 31, slit 16 extends in the Y direction (i.e., the direction of the winding axis of coil 21).

In the present embodiment, as shown in FIG. 2B, the slit is formed not only in the electromagnetic steel sheet located at an end of the plurality of electromagnetic steel sheets aligned in the Z direction (i.e., facing the inner peripheral surface of the coil), but also in electromagnetic steel sheets aligned consecutively from the electromagnetic steel sheet in the Z direction. Therefore, in the present embodiment, the slit is formed in a plurality of consecutive electromagnetic steel sheets. It is to be noted that an insulating film 32 is arranged on the main surface of each of stacked electromagnetic steel sheets 31.

Figure 3A:
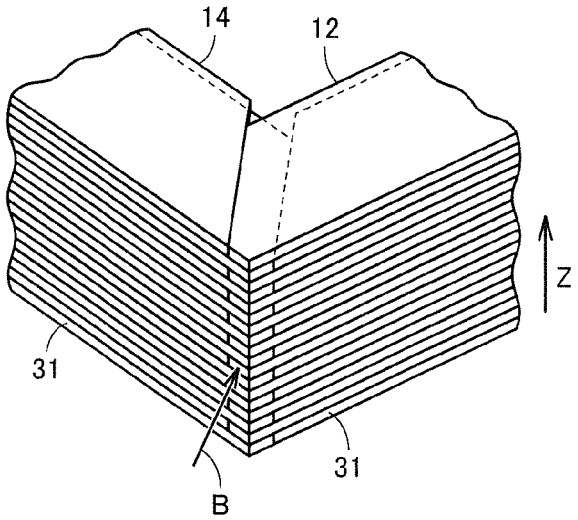
FIG. 3A is a perspective view of a portion surrounded by a two-dot chain line III in FIG. 2A.
Figure 3B:
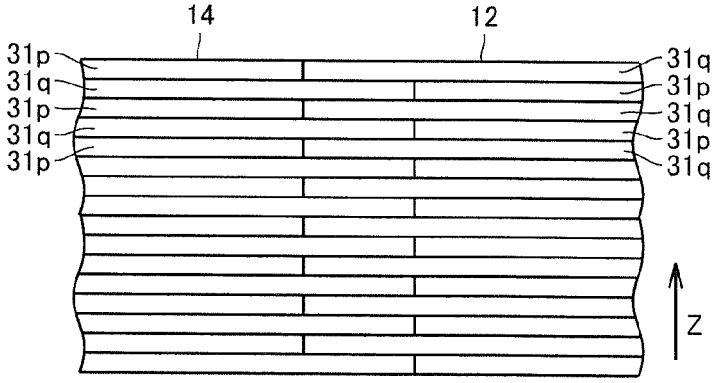
FIG. 3B is a side view viewed from a direction indicated by an arrow B in FIG. 3A.

FIGS. 3A and 3B are views showing a portion surrounded by a two-dot chain line III in FIG. 2A in an enlarged manner. FIG. 3A is a perspective view of the portion surrounded by two-dot chain line III in FIG. 2A, and FIG. 3B is a side view viewed from a direction indicated by an arrow B in FIG. 3A.

Referring to FIGS. 3A and 3B, yoke iron core 12 and leg iron core 14 are joined to each other by engagement between electromagnetic steel sheets 31 constituting the respective iron cores. A structure thereof will be described in detail. The plurality of electromagnetic steel sheets 31 constituting each iron core include first electromagnetic steel sheets 31*p* and second electromagnetic steel sheets 31*q*. The first electromagnetic steel sheets 31*p* and the second electromagnetic steel sheets 31*q* are alternately stacked, one by one.

At a position for joining yoke iron core 12 and leg iron core 14, an end portion of electromagnetic steel sheet 31*q* protrudes more than a tip end of electromagnetic steel sheet 31*p*. A gap is formed between electromagnetic steel sheets 31*q* adjacent to each other in the stacking direction. In each of yoke iron core 12 and leg iron core 14, electromagnetic steel sheet 31*p* is inserted into the gap formed between electromagnetic steel sheets 31*q*.

FIGS. 3A and 3B show one example of the configuration of each iron core, and the configuration of the iron core is not limited to the form shown in FIGS. 3A and 3B. For example, iron core 15 may be configured by alternately stacking a plurality of electromagnetic steel sheets 31*p* and a plurality of electromagnetic steel sheets 31*q*.

Next, the slit will be described in detail with reference to FIGS. 4 and 5. For understanding of the embodiments of the present invention, the electromagnetic steel sheet constituting the leg iron core may be shown in the shape of a rectangle in the drawings described below.

Figure 4:
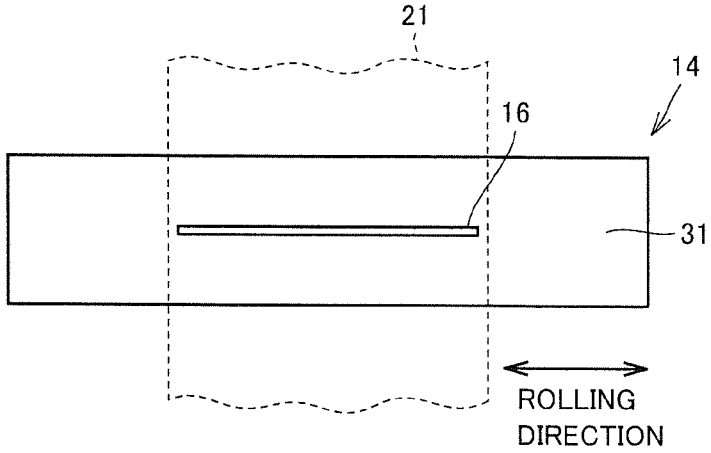
FIG. 4 is a view showing a positional relationship between the coil and a slit.

FIG. 4 is a view showing a positional relationship between the coil and the slit. Referring to FIG. 4, when viewed from the stacking direction of the plurality of electromagnetic steel sheets, slit 16 is formed along the extending direction of electromagnetic steel sheet 31, that is, a rolling direction of the electromagnetic steel sheet. Since a directional steel sheet is used as electromagnetic steel sheet 31 in the embodiments of the present invention, the rolling direction of the directional steel sheet is a direction of an easy axis of magnetization. Directional steel sheet 31 is arranged such that the rolling direction of directional steel sheet 31 is along the direction of the winding axis of coil 21.

Figure 5:
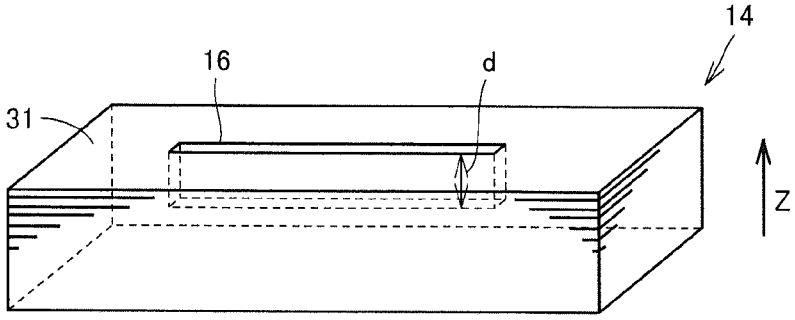
FIG. 5 is a view for illustrating a depth of the slit.

FIG. 5 is a view for illustrating a depth of the slit. Referring to FIG. 5, the Z direction indicates the direction of the Z axis shown in FIG. 1. Since slit 16 is formed consecutively in the plurality of electromagnetic steel sheets 31, slit 16 has a depth d in the stacking direction of the plurality of electromagnetic steel sheets 31 (Z direction).

Depth d of slit 16 can be determined appropriately as a value for reducing loss due to eddy current generated in the iron core (i.e., eddy current loss). By determining depth d of slit 16 beforehand, the number of electromagnetic steel sheets 31 in which slit 16 should be formed can be determined. Therefore, there is no need to form slit 16 in all of electromagnetic steel sheets 31 constituting leg iron core 14. By limiting the number of electromagnetic steel sheets 31 in which slit 16 should be formed, the cost for processing the slit can be reduced, and thus the cost for manufacturing the iron core can be reduced.

Figure 6:
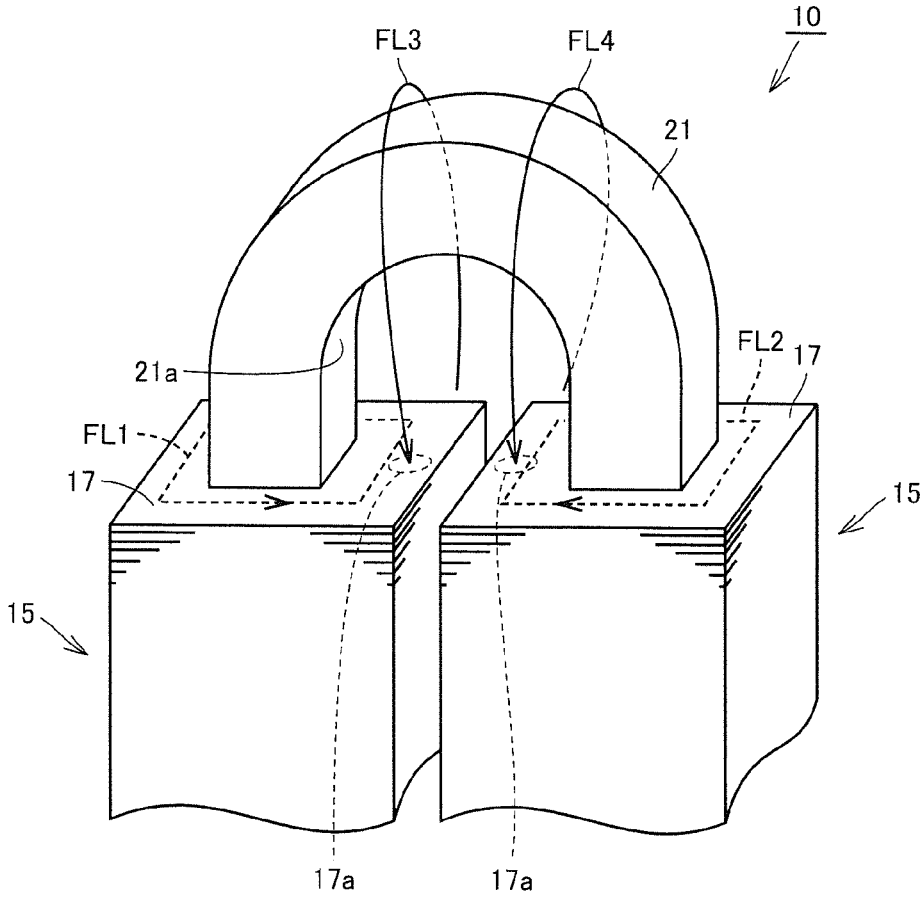
FIG. 6 is a view for illustrating magnetic fluxes generated by the coil.

Eddy current is generated by entry of magnetic flux generated by coil 21 into the electromagnetic steel sheet constituting iron core 15 (in particular, leg iron core 14). As shown in FIG. 6, magnetic fluxes FL1, FL2 generated by coil 21 flow through the closed magnetic circuits configured by iron cores 15. Magnetic fluxes FL1, FL2 respectively flowing through two iron cores 15 are magnetic fluxes which contribute to a transformation operation of transformer 10. On the other hand, magnetic fluxes FL3, FL4 generated by coil 21 enter regions 17*a* facing an inner peripheral surface 21*a* of coil 21, of main surfaces 17 of iron cores 15. Region 17*a* is a region corresponding to a surface of leg iron core 14. Entry of magnetic fluxes FL3, FL4 into iron cores 15 (leg iron cores 14) results in eddy current in iron cores 15 (leg iron cores 14).

Figure 7A:
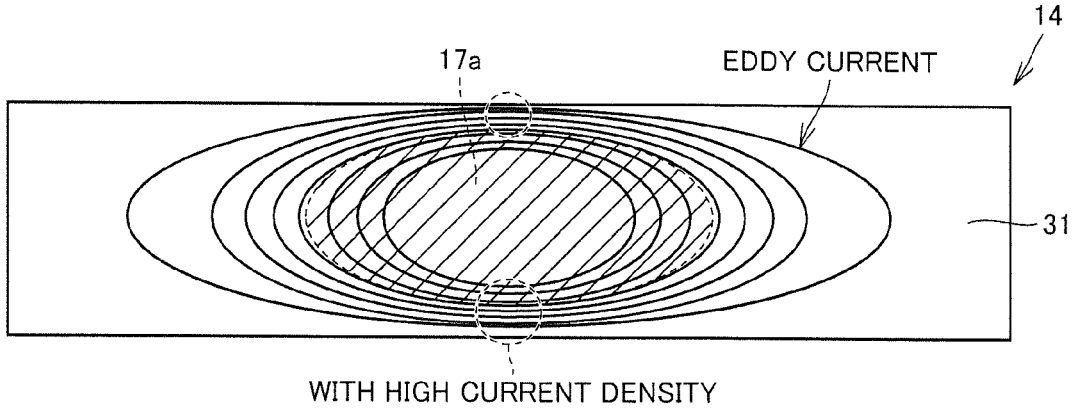
FIG. 7A is a view showing eddy current distribution in a surface of an electromagnetic steel sheet having no slit formed therein.
Figure 7B:
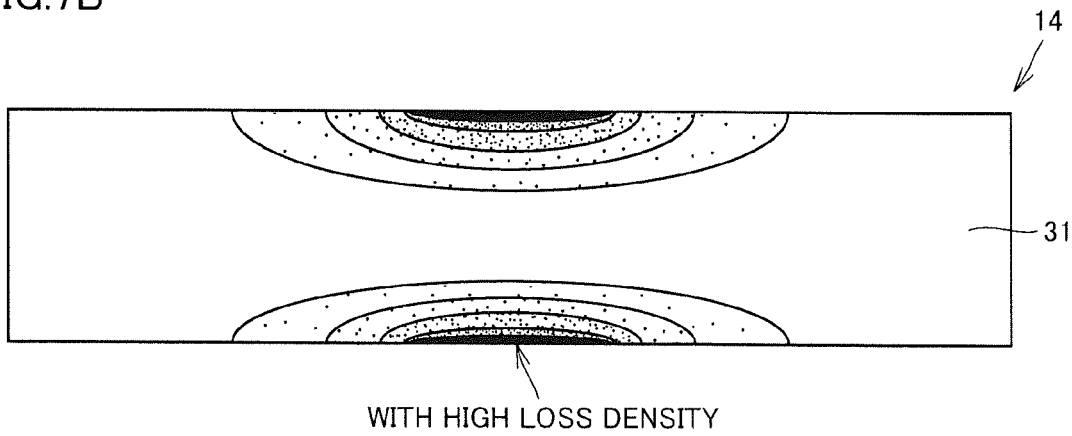
FIG. 7B is a view showing loss density in the surface of the electromagnetic steel sheet having no slit formed therein.

FIGS. 7A and 7B are views for illustrating eddy current and eddy current loss generated in an electromagnetic steel sheet constituting the leg iron core when no slit is formed in the electromagnetic steel sheet. FIG. 7A is a view showing eddy current distribution in a surface of the electromagnetic steel sheet having no slit formed therein. FIG. 7B is a view showing loss density in the surface of the electromagnetic steel sheet having no slit formed therein.

Referring to FIG. 7A, a region through which magnetic flux penetrates in the main surface of electromagnetic steel sheet 31 is designated by numeral 17*a*, as in FIG. 6. Region 17*a*, through which the magnetic flux from coil 21 penetrates, has a high magnetic flux density.

Eddy current is generated by penetration of the magnetic flux through the electromagnetic steel sheet. The eddy current has a higher density with increasing distance from the center toward the periphery of magnetic flux distribution. Accordingly, current density becomes high, for example, at a position surrounded by a broken line in FIG. 7A. Since this portion has a high current density, it also has a high loss density as shown in FIG. 7B.

Figure 8A:
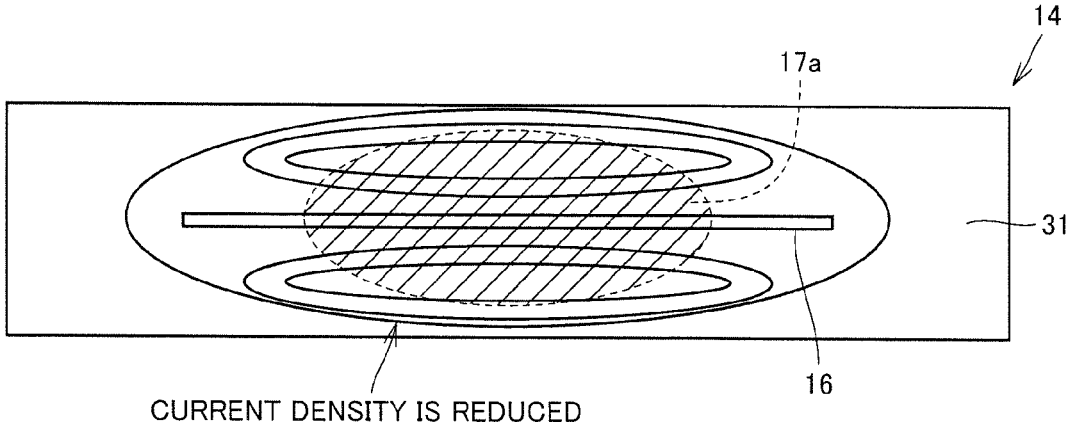
FIG. 8A is a view showing eddy current distribution in a surface of an electromagnetic steel sheet in accordance with Embodiment 1 of the present invention.
Figure 8B:
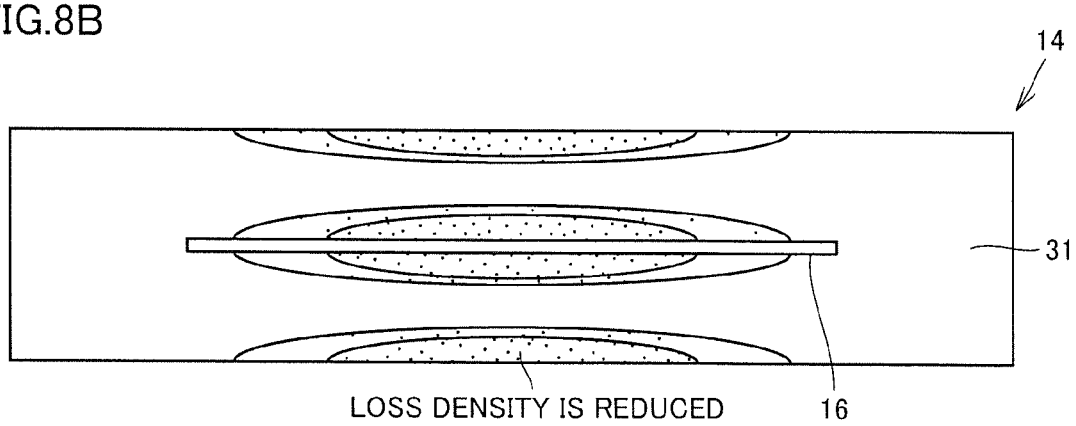
FIG. 8B is a view showing loss density in the surface of the electromagnetic steel sheet in accordance with Embodiment 1 of the present invention.

FIGS. 8A and 8B are schematic views for illustrating eddy current and eddy current loss generated in the leg iron core in accordance with Embodiment 1 of the present invention. FIG. 8A is a view showing eddy current distribution in a surface of an electromagnetic steel sheet in accordance with Embodiment 1 of the present invention. FIG. 8B is a view showing loss density in the surface of the electromagnetic steel sheet in accordance with Embodiment 1 of the present invention.

Referring to FIGS. 8A and 8B, eddy current is divided by forming slit 16 in electromagnetic steel sheet 31 which faces the inner peripheral surface of the coil. The density of the eddy current can be reduced by dividing the eddy current. Since a reduction in current density can reduce loss density, eddy current loss in the iron core can be reduced according to Embodiment 1 of the present invention.

By reducing the eddy current loss, electric power to be consumed by the transformer can be reduced. As a result, the transformer can have an improved efficiency. By improving the efficiency of the transformer, the transformer can have a smaller size and a lighter weight.

Further, in Embodiment 1, the slit is formed in a plurality of electromagnetic steel sheets aligned consecutively in the stacking direction, of the plurality of electromagnetic steel sheets constituting the leg iron core. Thereby, eddy current can be further reduced. Therefore, loss due to eddy current can be further reduced.

Furthermore, according to Embodiment 1, slit 16 is formed in the electromagnetic steel sheets to extend along the rolling direction of the electromagnetic steel sheets (directional steel sheets). The rolling direction of the electromagnetic steel sheets (directional steel sheets) is the extending direction of the electromagnetic steel sheets. In Embodiment 1, each of the plurality of electromagnetic steel sheets constituting the leg iron core is arranged such that the extending direction of each of the plurality of electromagnetic steel sheets is along the direction of the winding axis of coil 21.

The thin-sheet type magnetic body used for an iron core of a transformer is required to have a function of allowing main magnetic flux to flow therethrough efficiently. Therefore, in Embodiment 1, the directional steel sheet which is easily magnetized in a specific direction (i.e., rolling direction) is used as the magnetic sheet for the iron core. As shown in FIG. 6, magnetic fluxes FL1, FL2 contributing to the transformation operation flow along the extending direction of the electromagnetic steel sheets.

There is a possibility that, depending on the extending direction of a slit, the slit may interrupt flow of the main magnetic flux contributing to the transformation operation. In Embodiment 1, since the extending direction of slit 16 is parallel to the rolling direction of the electromagnetic steel sheet (directional steel sheet), the slit is formed along a direction having the highest magnetic permeability. Thereby, eddy current loss in the iron core can be reduced effectively while suppressing deterioration of the function of allowing magnetic flux contributing the transformation operation to flow therethrough, which is a primary function of the magnetic sheet.

Embodiment 2

In Embodiment 2, a slit is formed in a magnetic sheet such that one end of the slit reaches an end portion of the magnetic sheet.

Figure 9A:
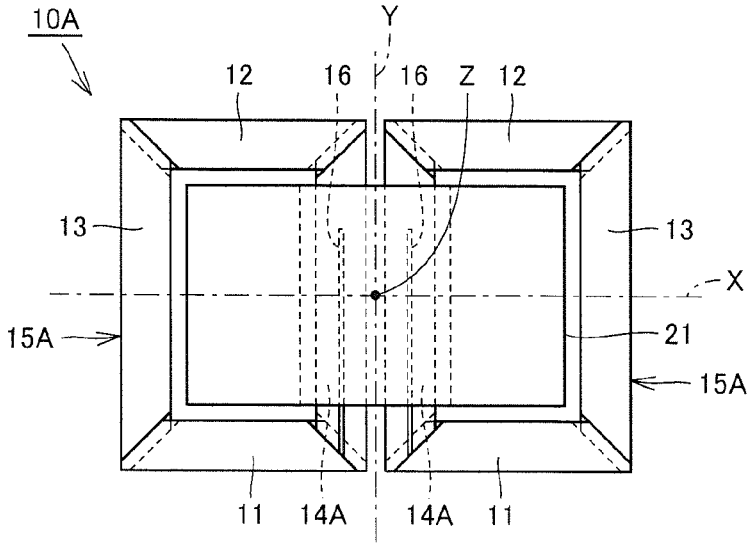
FIG. 9A is a view of a transformer in accordance with Embodiment 2 of the present invention when viewed from a stacking direction of a plurality of magnetic sheets constituting an iron core.
Figure 9B:
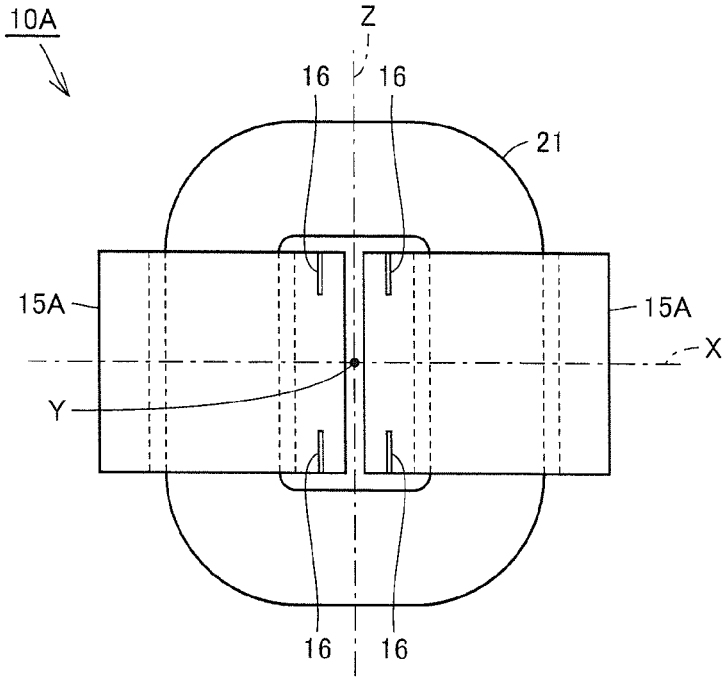
FIG. 9B is a view of the transformer in accordance with Embodiment 2 of the present invention when viewed from a direction of a winding axis of a coil.

FIGS. 9A and 9B are views schematically showing a structure of a transformer in accordance with Embodiment 2 of the present invention. FIG. 9A is a view of the transformer in accordance with Embodiment 2 of the present invention when viewed from a stacking direction of a plurality of magnetic sheets constituting an iron core. FIG. 9B is a view of the transformer in accordance with Embodiment 2 of the present invention when viewed from a direction of a winding axis of a coil.

Referring to FIGS. 9A, 9B and FIGS. 1A, 1B, a transformer 10A is different from transformer 10 in that it includes iron cores 15A instead of iron cores 15. Iron core 15A is different from iron core 15 in that it includes a leg iron core 14A instead of leg iron core 14.

Figure 10:
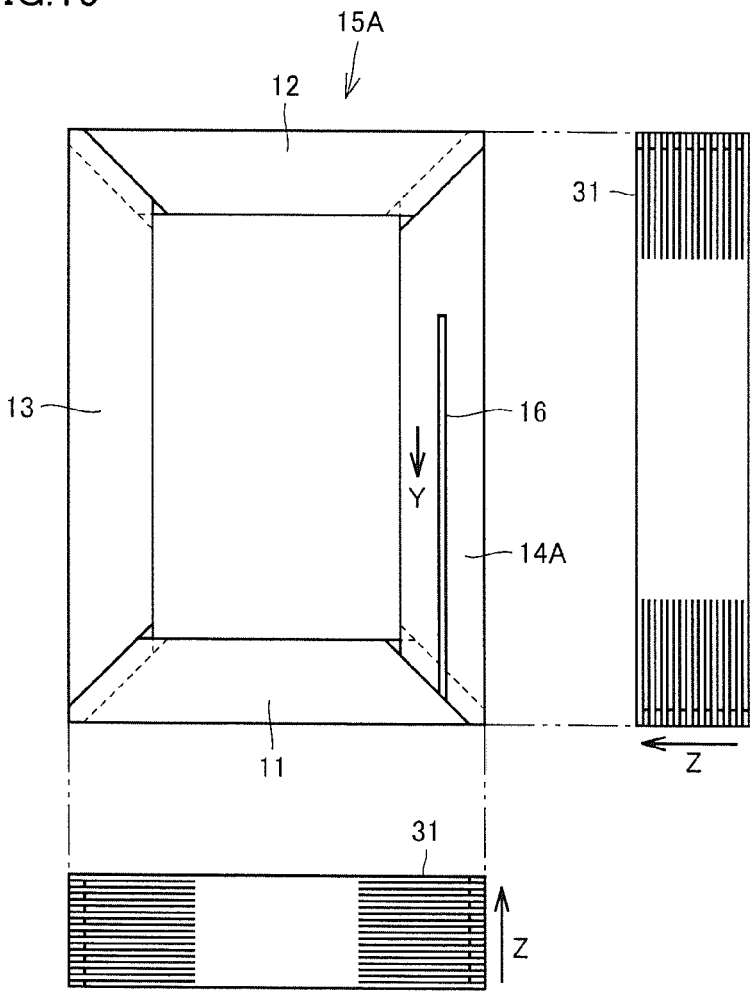
FIG. 10 is a plan view showing the iron core included in the transformer shown in FIGS. 9A and 9B.
Figure 11:
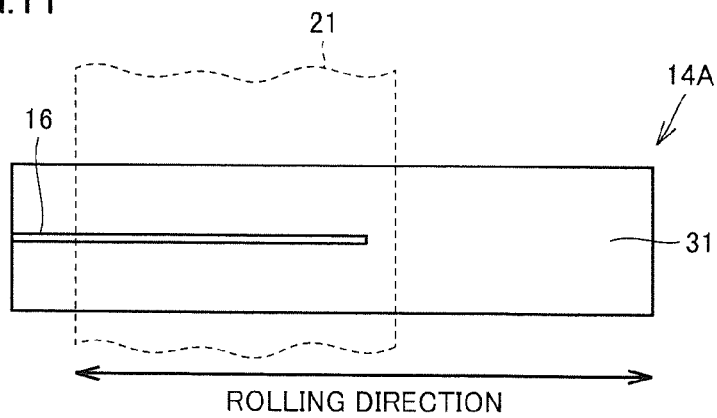
FIG. 11 is a plan view schematically showing a leg iron core in accordance with Embodiment 2.

FIG. 10 is a plan view showing the iron core shown in FIGS. 9A and 9B. FIG. 11 is a plan view schematically showing the leg iron core in accordance with Embodiment 2. Referring to FIGS. 9A, 9B, 10, and 11, slit 16 is formed such that one end thereof reaches an end portion of the magnetic sheet located in the extending direction of the magnetic sheet (electromagnetic steel sheet 31). In this respect, Embodiment 2 is different from Embodiment 1. It is to be noted that other portions of iron core 15A are configured to be identical to the corresponding portions of iron core 15.

The slit is formed in a magnetic sheet which faces the inner peripheral surface of coil 21, of the plurality of magnetic sheets constituting leg iron core 14A. However, as in Embodiment 1, the slit may be formed not only in the magnetic sheet facing the inner peripheral surface of coil 21, but also in a plurality of electromagnetic steel sheets aligned consecutively from the electromagnetic steel sheet in the Z direction.

Coil 21 overlaps one end of slit 16, whereas the other end of the slit reaches an end portion of electromagnetic steel sheet 31. In this respect, the leg iron core in accordance with Embodiment 2 is different from the leg iron core in accordance with Embodiment 1. Other portions of leg iron core 14A are configured to be identical to the corresponding portions of leg iron core 14 in accordance with Embodiment 1.

Eddy current has a higher density with increasing distance from the center toward the periphery of magnetic flux distribution. Accordingly, the eddy current is likely to have a high density at the end portion of the magnetic body located in the extending direction of the magnetic sheet. By forming the slit such that one end thereof reaches the end portion of the magnetic sheet, eddy current at the end portion of the magnetic sheet described above can be suppressed. Therefore, according to Embodiment 2, the effect of suppressing eddy current loss in the iron core can be further improved.

Embodiment 3

In Embodiment 3, a slit is formed in each of two magnetic sheets adjacent in a stacking direction such that there is no overlap between the slits in the two magnetic sheets.

Figure 12A:
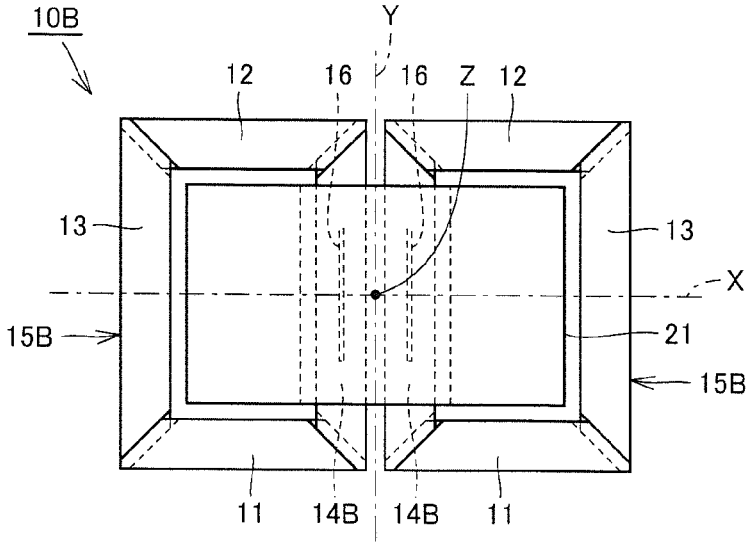
FIG. 12A is a view of a transformer in accordance with Embodiment 3 of the present invention when viewed from a stacking direction of a plurality of magnetic sheets constituting an iron core.
Figure 12B:
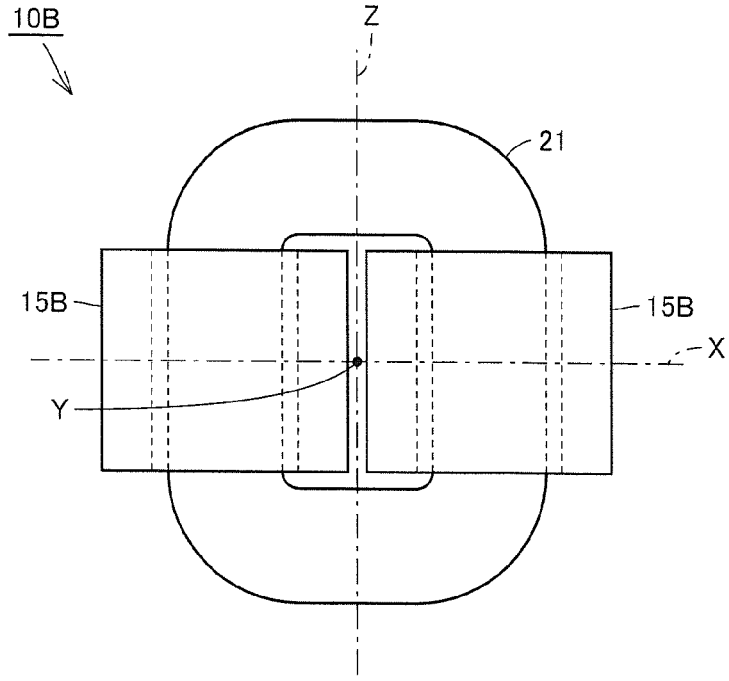
FIG. 12B is a view of the transformer in accordance with Embodiment 3 of the present invention when viewed from a direction of a winding axis of a coil.

FIGS. 12A and 12B are views schematically showing a structure of a transformer in accordance with Embodiment 3 of the present invention. FIG. 12A is a view of the transformer in accordance with Embodiment 3 of the present invention when viewed from a stacking direction of a plurality of magnetic sheets constituting an iron core. FIG. 12B is a view of the transformer in accordance with Embodiment 3 of the present invention when viewed from a direction of a winding axis of a coil.

Referring to FIGS. 12A, 12B and FIGS. 1A, 1B, a transformer 10B is different from transformer 10 in that it includes iron cores 15B instead of iron cores 15. Iron core 15B is different from iron core 15 in that it includes a leg iron core 14B instead of leg iron core 14.

Figure 13:
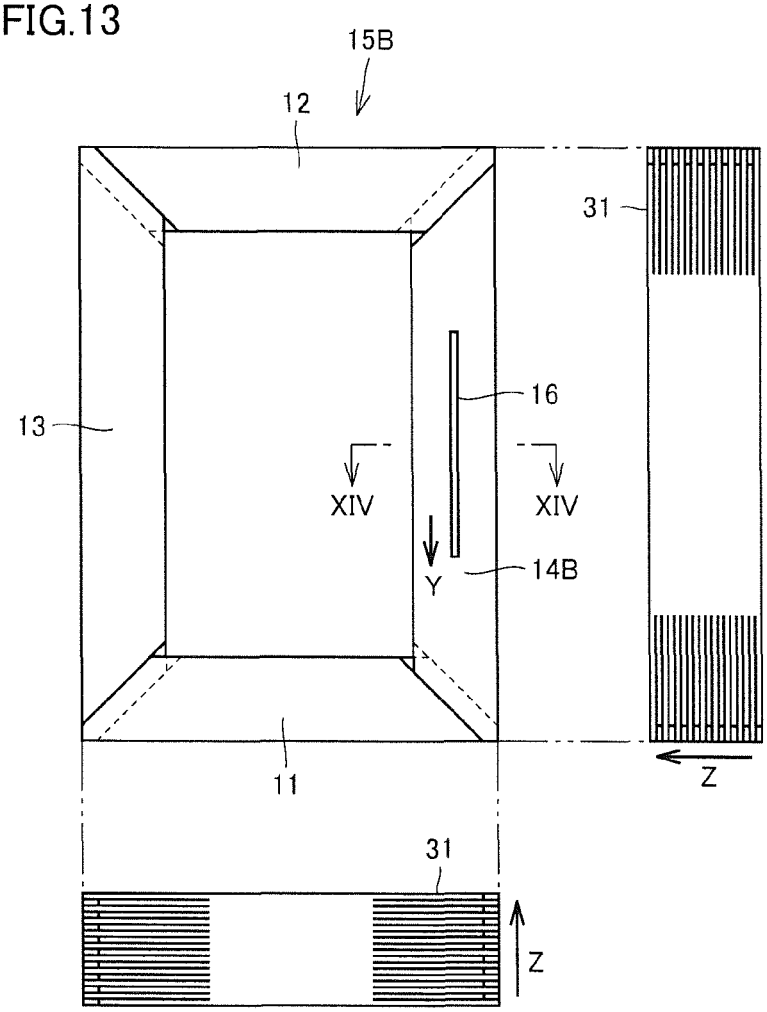
FIG. 13 is a plan view showing the iron core shown in FIGS. 12A and 12B.
Figure 14:
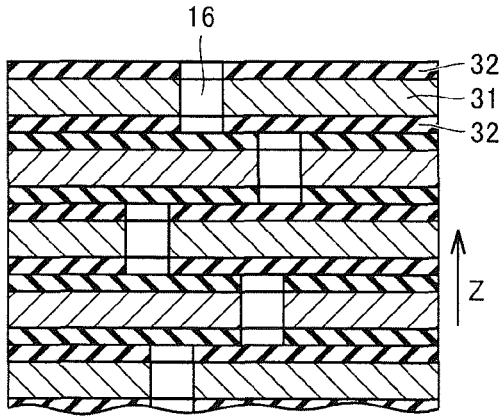
FIG. 14 is a view showing a cross section along XIV-XIV in FIG. 13 in a partially enlarged manner.

FIG. 13 is a plan view showing the iron core shown in FIGS. 12A and 12B. FIG. 14 is a view showing a cross section along XIV-XIV in FIG. 13 in a partially enlarged manner. Referring to FIGS. 13 and 14, positions of slits 16 are out of alignment from each other in two electromagnetic steel sheets 31 adjacent in the stacking direction. It is to be noted that other portions of iron core 15B are configured to be identical to those of iron core 15.

Figure 15:
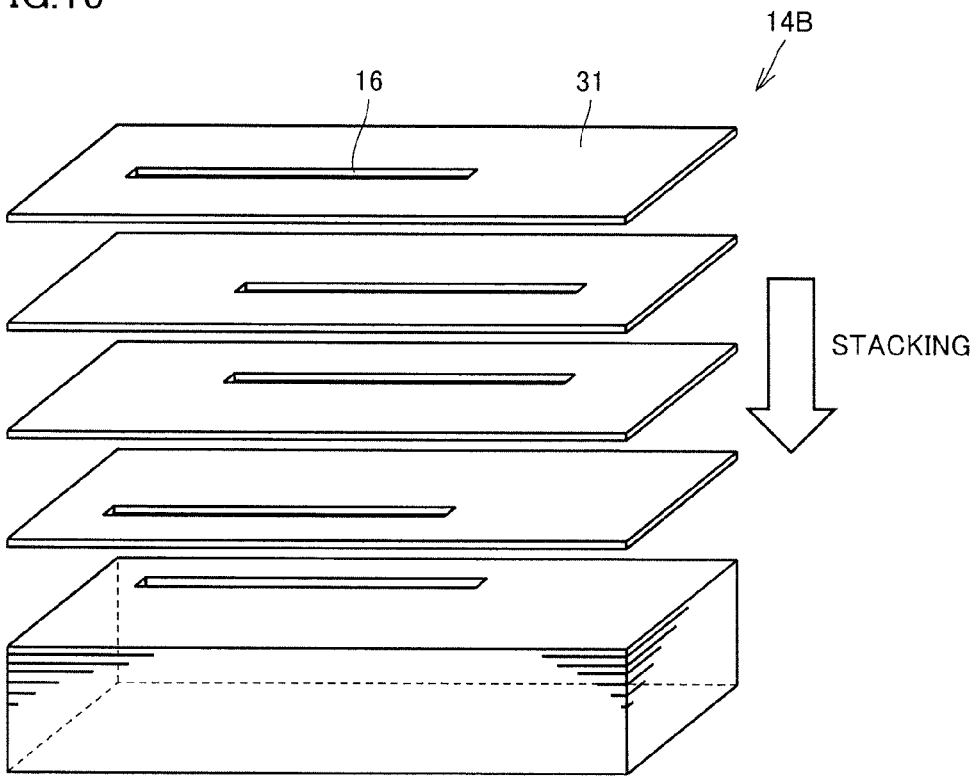
FIG. 15 is a view for schematically illustrating a method of manufacturing the iron core shown in FIGS. 12A and 12B.

FIG. 15 is a view for schematically illustrating a method of manufacturing the iron core shown in FIGS. 12A and 12B. Referring to FIG. 15, a plurality of electromagnetic steel sheets 31 each having a slit formed therein are prepared beforehand. Positions of the slits in the main surfaces of electromagnetic steel sheets 31 are not completely identical. When electromagnetic steel sheets 31 are stacked to manufacture the iron core, electromagnetic steel sheet 31 having a slit formed at a position where the slit does not overlap a slit in electromagnetic steel sheet 31 located below in the stacking direction is selected, and stacked.

Generally, the magnitude of eddy current is proportional to the square of the thickness of a magnetic sheet. In the embodiments of the present invention, eddy current can be reduced by stacking thin magnetic sheets insulated from each other to constitute an iron core. Further, in the embodiments of the present invention, a slit is formed in at least a magnetic sheet which faces an inner peripheral surface of a coil. Thereby, eddy current loss caused in the iron core can be further reduced.

However, there is a possibility that, when a slit is formed in a magnetic sheet (for example, when a slit is formed by press drilling), an insulating film around the slit may come off. If the positions of the slits in two electromagnetic steel sheets 31 adjacent in the stacking direction overlap each other, there is a possibility that exposed portions of the electromagnetic steel sheets may come into contact with each other and thereby electrical conduction may be established between these two electromagnetic steel sheets. If electrical conduction is established between the electromagnetic steel sheets, the effect of reducing eddy current is decreased.

According to Embodiment 3, since there is no overlap between the slits in two electromagnetic steel sheets 31 adjacent in the stacking direction, the possibility that electrical conduction may be established between these two electromagnetic steel sheets 31 can be reduced, even if the insulating film around the slit comes off Therefore, according to Embodiment 3, the effect of reducing eddy current can be expected more reliably.

Further, according to Embodiment 3, since there is no need to form the slits in the plurality of magnetic sheets at a completely identical position, conditions on the processing of the slits (such as a position to be processed) can be widened. Therefore, the processing of the slits is facilitated, and thus the cost for manufacturing the iron core can be reduced.

It is to be noted that, also in Embodiment 3, the slit may be formed such that one end of the slit reaches an end portion of the magnetic sheet, as in Embodiment 2.

Embodiment 4

In Embodiment 4, a transformer further includes an electromagnetic shield inserted between a coil and an iron core, in addition to any of the configurations in Embodiments 1 to 3.

Figure 16A:
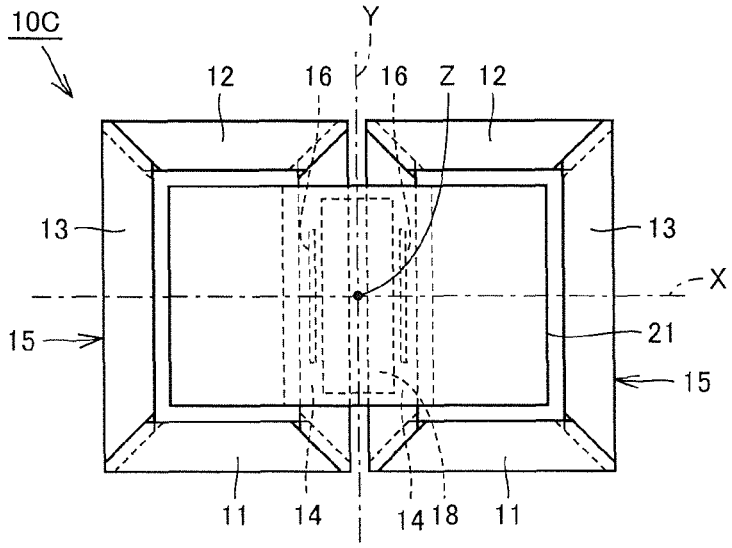
FIG. 16A is a view of a transformer, in accordance with Embodiment 4 of the present invention when viewed from a stacking direction of a plurality of magnetic sheets constituting an iron core.
Figure 16B:
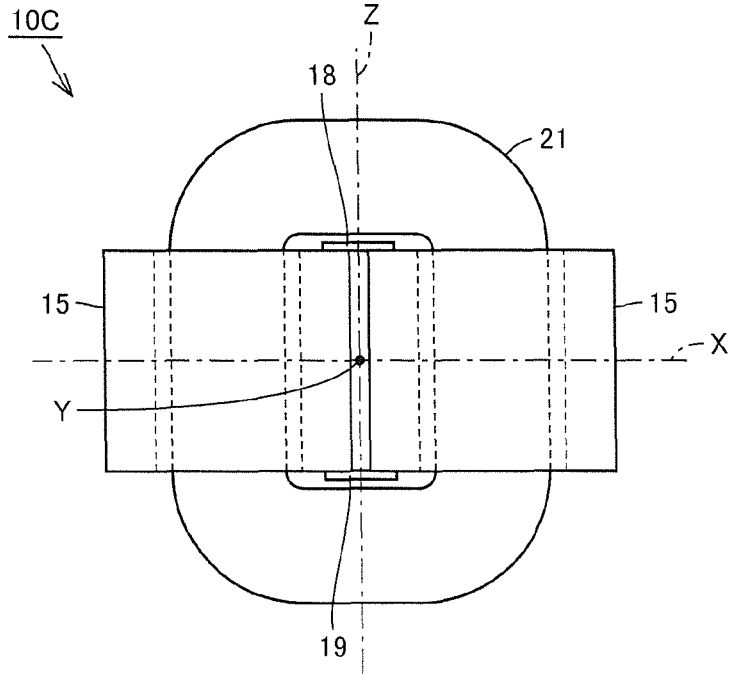
FIG. 16B is a view of the transformer in accordance with Embodiment 4 of the present invention when viewed from a direction of a winding axis of a coil.

FIGS. 16A and 16B are views schematically showing a structure of a transformer in accordance with Embodiment 4 of the present invention. FIG. 16A is a view of the transformer in accordance with Embodiment 4 of the present invention when viewed from a stacking direction of a plurality of magnetic sheets constituting an iron core. FIG. 16B is a view of the transformer in accordance with Embodiment 4 of the present invention when viewed from a direction of a winding axis of a coil.

Referring to FIGS. 16A, 16B and FIGS. 1A, 1B, a transformer 10C is different from transformer 10 in that it further includes electromagnetic shields 18, 19 each arranged between coil 21 and two leg iron cores 14. Specifically, each of electromagnetic shields 18, 19 is inserted between the inner peripheral surface of coil 21 and the magnetic sheet which faces the inner peripheral surface.

Figure 17:
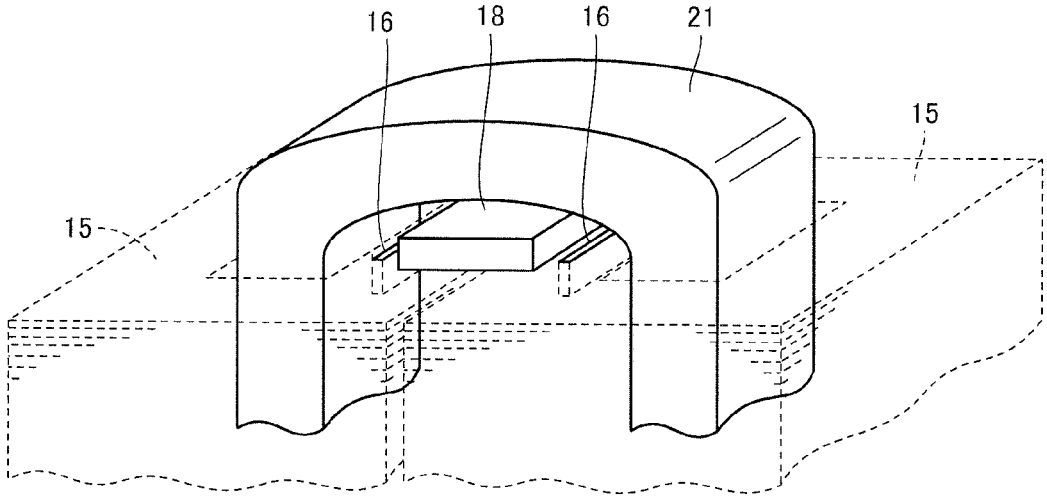
FIG. 17 is a perspective view for illustrating an arrangement of an electromagnetic shield and slits in accordance with Embodiment 4.
Figure 18:
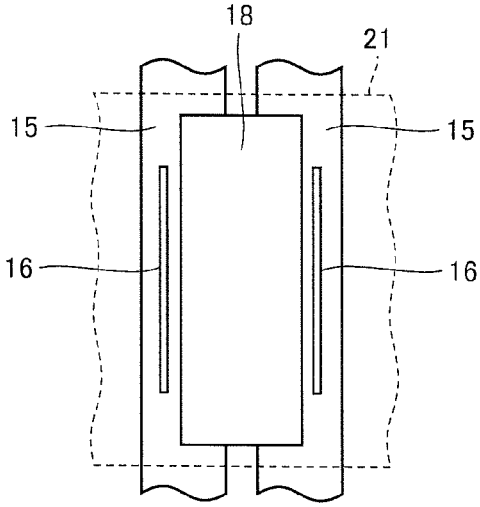
FIG. 18 is a plan view for illustrating the arrangement of the electromagnetic shield and the slits in accordance with Embodiment 4.

FIG. 17 is a perspective view for illustrating an arrangement of an electromagnetic shield and slits in accordance with Embodiment 4. FIG. 18 is a plan view for illustrating the arrangement of the electromagnetic shield and the slits in accordance with Embodiment 4. It is to be noted that FIG. 18 shows a state where the electromagnetic shield and the slits are seen through from the stacking direction of the plurality of magnetic sheets constituting the iron core.

Referring to FIGS. 17 and 18, when viewed from the stacking direction of the plurality of magnetic sheets, slit 16 is formed in a region not overlapped with electromagnetic shield 18. Also when the shield and the slits arc seen through from the electromagnetic shield 19 side along the stacking direction of the plurality of magnetic sheets, slit 16 is formed in a region not overlapped with electromagnetic shield 19, in at least an electromagnetic steel sheet which faces the inner peripheral surface of the coil.

By inserting electromagnetic shield 18 between the inner peripheral surface of coil 21 and leg iron core 14, eddy current loss in the iron core can be reduced. However, since the inner peripheral surface of the coil is a curved surface, a portion not covered with electromagnetic shield 18 is generated in the surface of leg iron core 14. If magnetic flux from coil 21 enters this portion, eddy current may be generated, and loss density may be increased.

In Embodiment 4, since the slit is formed in the region not overlapped with the electromagnetic shield when viewed from the stacking direction of the plurality of magnetic sheets, loss due to eddy current can be reduced in this region. That is, according to Embodiment 4, eddy current generated in the iron core can be reduced by both the electromagnetic shield and the slit. Therefore, eddy current loss in the iron core can be further reduced.

It is to be noted that the slit may be formed such that one end of the slit reaches an end portion of the magnetic sheet, as in Embodiment 2. Further, as long as the electromagnetic shield does not overlap the slit when viewed from the stacking direction of the plurality of magnetic sheets, the slit may be formed in a plurality of electromagnetic steel sheets such that there is no overlap between the slits in two electromagnetic steel sheets adjacent in the stacking direction, as in Embodiment 3.

As a matter of course, a combination of Embodiment 2 and Embodiment 3 may be applied to Embodiment 4.

Embodiment 5

Figure 19A:
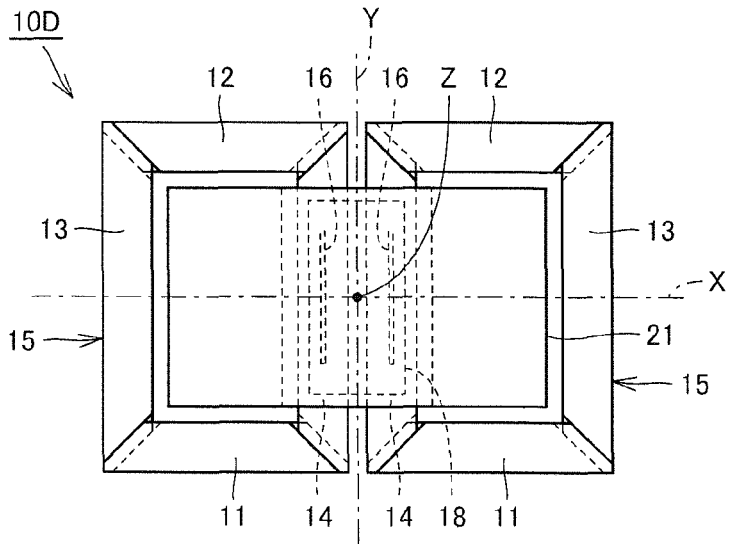
FIG. 19A is a view of a transformer in accordance with Embodiment 5 of the present invention when viewed from a stacking direction of a plurality of magnetic sheets constituting an iron core.
Figure 19B:
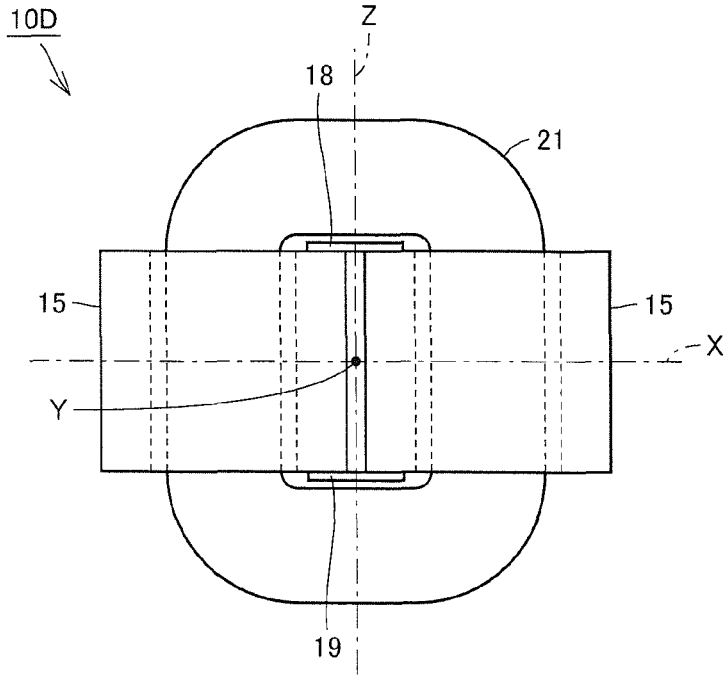
FIG. 19B is a view of the transformer in accordance with Embodiment 5 of the present invention when viewed from a direction of a winding axis of a coil.

FIGS. 19A and 19B are views schematically showing a structure of a transformer in accordance with Embodiment 5 of the present invention. FIG. 19A is a view of the transformer in accordance with Embodiment 5 of the present invention when viewed from a stacking direction of a plurality of magnetic sheets constituting an iron core. FIG. 19B is a view of the transformer in accordance with Embodiment 5 of the present invention when viewed from a direction of a winding axis of a coil. Referring to FIGS. 19A, 19B and FIGS. 16A, 16B, a transformer 10D is different from transformer 10C in that slit 16 is formed in a region overlapped with electromagnetic shield 18.

Figure 20:
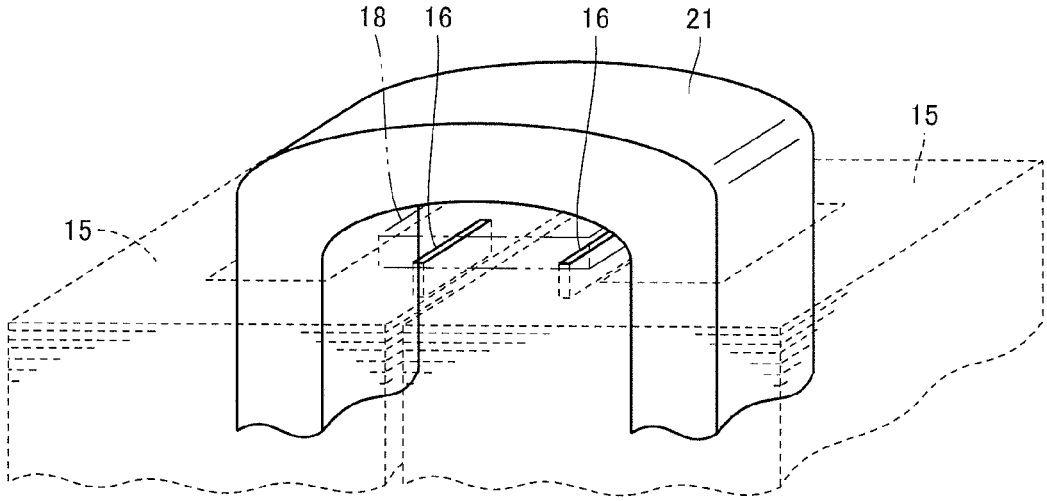
FIG. 20 is a perspective view for illustrating an arrangement of an electromagnetic shield and slits in accordance with Embodiment 5.
Figure 21:
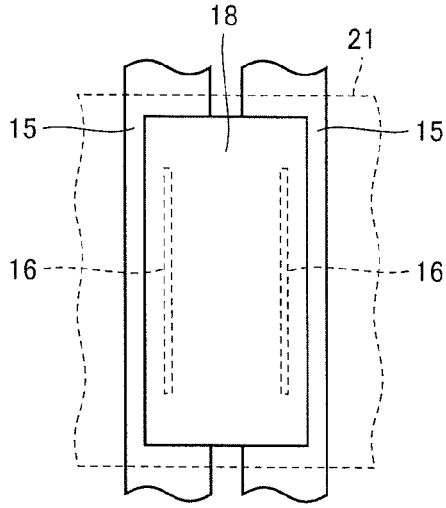
FIG. 21 is a plan view for illustrating the arrangement of the electromagnetic shield and the slits in accordance with Embodiment 5.

FIG. 20 is a perspective view for illustrating an arrangement of an electromagnetic shield and slits in accordance with Embodiment 5. FIG. 21 is a plan view for illustrating the arrangement of the electromagnetic shield and the slits in accordance with Embodiment 5. FIG. 21 shows a state where the electromagnetic shield and the slits are seen through from the stacking direction of the plurality of magnetic sheets constituting the iron core, as with FIG. 18. Referring to FIGS. 20 and 21, when viewed from the stacking direction of the plurality of magnetic sheets, slit 16 is formed in a region overlapped with electromagnetic shield 18. Also when the shield and the slits are seen through from the electromagnetic shield 19 side along the stacking direction of the plurality of magnetic sheets, slit 16 is formed in a region overlapped with electromagnetic shield 19, in at least an electromagnetic steel sheet which faces the inner peripheral surface of the coil.

There is a possibility that, depending on the structure of the transformer, the electromagnetic shield should be reduced in thickness. In this case, magnetic flux from coil 21 may penetrate the electromagnetic shield and enter the iron core. According to Embodiment 5, eddy current generated by magnetic flux penetrating the electromagnetic shield and entering the iron core can be reduced by the slit. Therefore, according to Embodiment 5, eddy current can be effectively suppressed.

Further, according to Embodiment 5, since eddy current generated in the iron core can be reduced by a thin electromagnetic shield, the cost for the electromagnetic shield can be reduced. Therefore, according to Embodiment 5, the cost for the transformer can be reduced.

Modification of Embodiment 5

By combining the above embodiment with Embodiment 4, slits may be formed in both a region immediately below an electromagnetic shield and a region not covered with the electromagnetic shield, in the surface of the iron core. In this case, both the effect of reducing eddy current generated in the iron core and the effect of obtaining a thin electromagnetic shield can be achieved. It is to be noted that, preferably, the slits are formed such that the slit formed in the region not overlapped with the electromagnetic shield has a depth deeper than that of the slit formed in the region overlapped with the electromagnetic shield.

Further, in Embodiment 5 and a modification thereof, the slit may be formed such that one end of the slit reaches an end portion of the magnetic sheet, as in Embodiment 2. In addition, the slit may be formed in a plurality of electromagnetic steel sheets such that there is no overlap between the slits in two electromagnetic steel sheets adjacent in the stacking direction, as in Embodiment 3. Moreover, a combination of Embodiment 2 and Embodiment 3 may be applied to Embodiment 5 and the modification thereof.

Embodiment 6

Figure 22A:
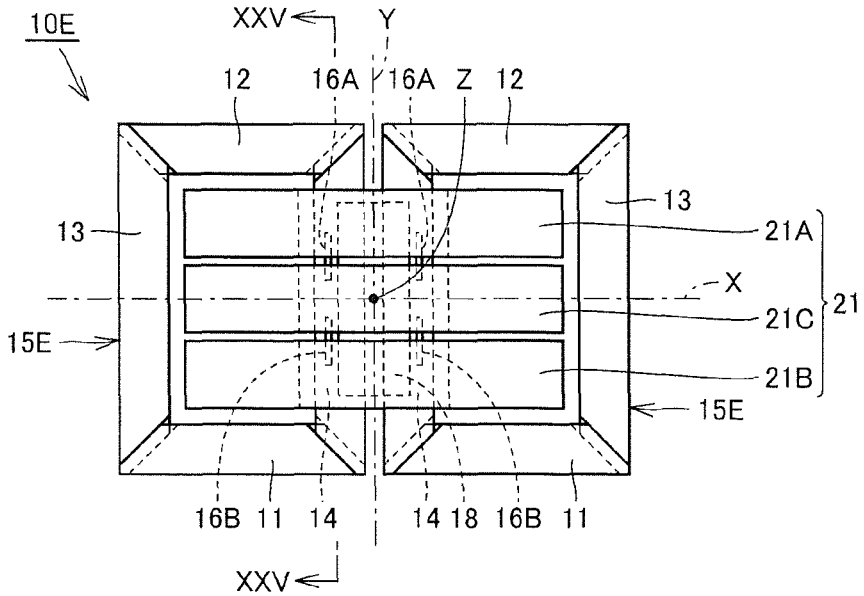
FIG. 22A is a view of a transformer in accordance with Embodiment 6 of the present invention when viewed from a stacking direction of a plurality of magnetic sheets constituting an iron core.
Figure 22B:
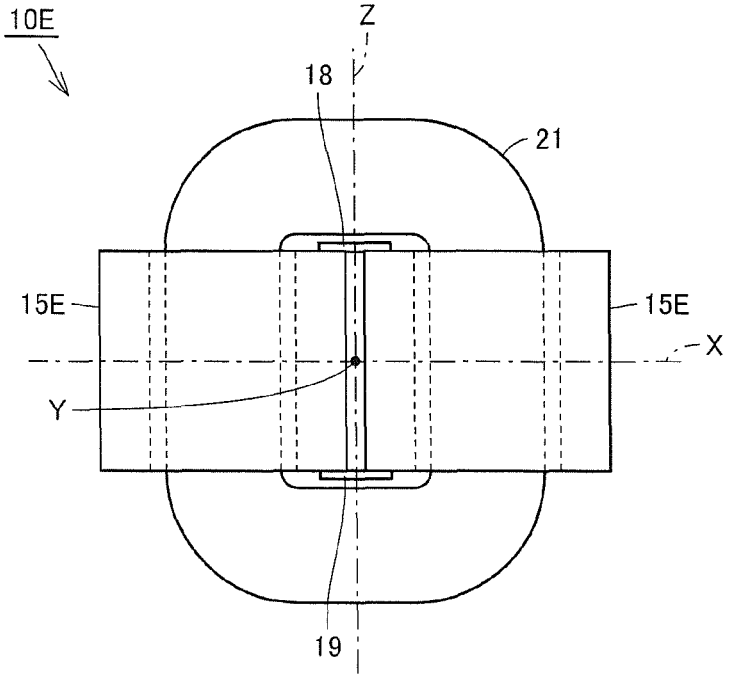
FIG. 22B is a view of the transformer in accordance with Embodiment 6 of the present invention when viewed from a direction of a winding axis of a coil.

FIGS. 22A and 22B are views schematically showing a structure of a transformer in accordance with Embodiment 6 of the present invention. FIG. 22A is a view of the transformer in accordance with Embodiment 6 of the present invention when viewed from a stacking direction of a plurality of magnetic sheets constituting an iron core. FIG. 22B is a view of the transformer in accordance with Embodiment 6 of the present invention when viewed from a direction of a winding axis of a coil.

Referring to FIGS. 22A and 22B, a transformer 10E includes low-voltage coils 21A, 21B, a high-voltage coil 21C, iron cores 15E, and electromagnetic shields 18, 19.

In the case of the transformers in accordance with Embodiments 4 and 5, the slit is continuously formed in the iron core (see for example FIG. 16A). In contrast, in Embodiment 6, a slit 16A is formed mainly in a portion between low-voltage coil 21A and high-voltage coil 21C, in iron core 15 (leg iron core 14). Similarly, a slit 16B is formed mainly in a portion between low-voltage coil 21B and high-voltage coil 21C, in iron core 15 (leg iron core 14). That is, the slits are formed intermittently in the iron core.

Figure 23:
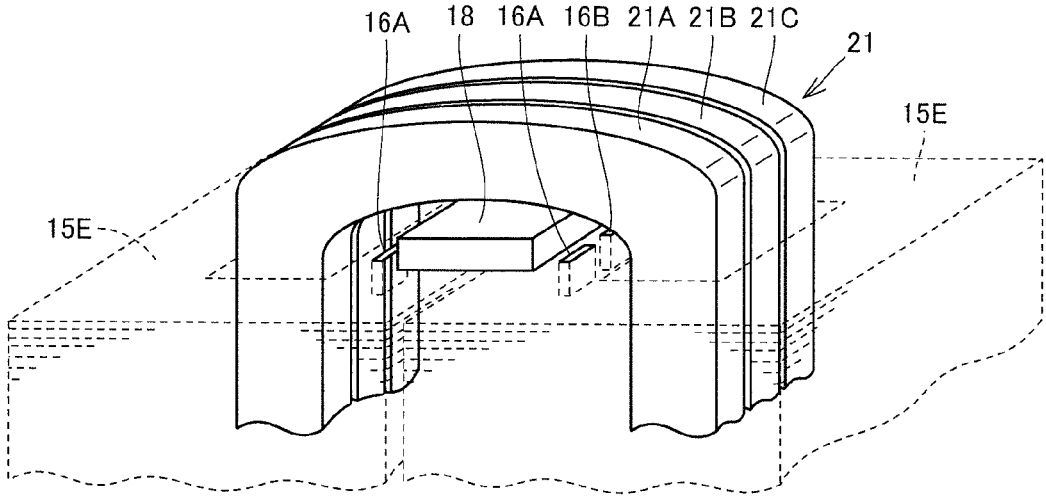
FIG. 23 is a perspective view for illustrating an arrangement of an electromagnetic shield and slits in accordance with Embodiment 6.
Figure 24:
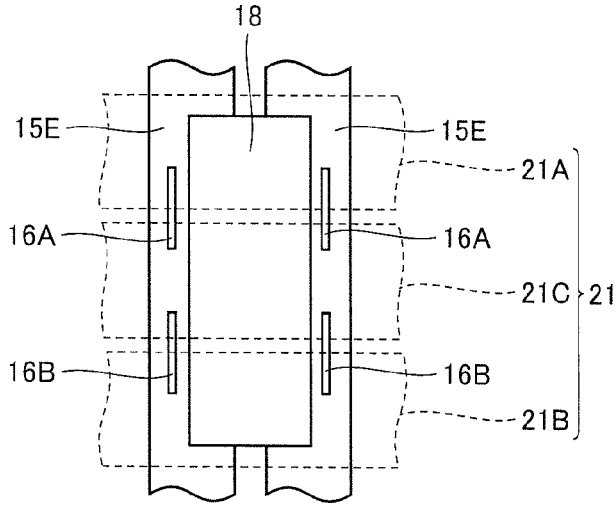
FIG. 24 is a plan view for illustrating the arrangement of the electromagnetic shield and the slits in accordance with Embodiment 6.

FIG. 23 is a perspective view for illustrating an arrangement of an electromagnetic shield and slits in accordance with Embodiment 6. FIG. 24 is a plan view for illustrating the arrangement of the electromagnetic shield and the slits in accordance with Embodiment 6. It is to be noted that FIG. 24 shows a state where the electromagnetic shield and the slits are seen through from the stacking direction of the plurality of magnetic sheets constituting the iron core. Referring to FIGS. 23 and 24, when viewed from the stacking direction of the plurality of magnetic sheets, slits 16A, 16B are formed in a region not overlapped with electromagnetic shield 18.

Figure 25:
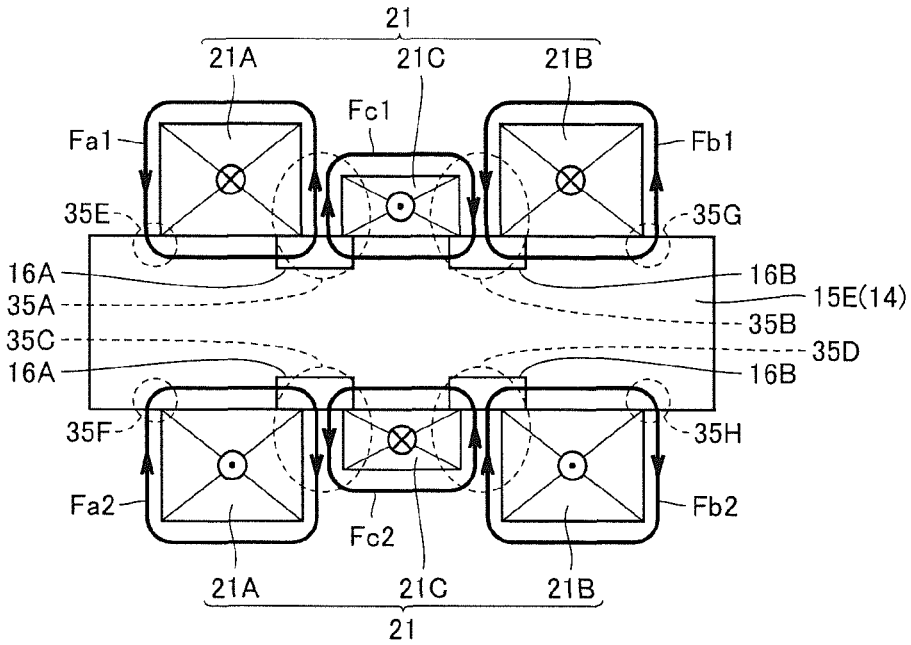
FIG. 25 is a view for illustrating flows of leaked magnetic fluxes from low-voltage coils and a high-voltage coil.

FIG. 25 is a view for illustrating flows of leaked magnetic fluxes from the low-voltage coils and the high-voltage coil. It is to be noted that FIG. 25 schematically shows a cross section of the transformer along a line XXV-XXV in FIG. 22A. Referring to FIG. 25, in a shell-type transformer, the low-voltage coils (21A, 21B) and the high-voltage coil (21C) are arranged in parallel. When the transformer is operated, leaked magnetic flux in a direction perpendicular to iron core 15E (leg iron core 14) is generated from each of the high-voltage coil and the low-voltage coils. Magnetic fluxes Fa1, Fa2 are leaked magnetic fluxes generated by low-voltage coil 21A, magnetic fluxes Fb1, Fb2 are magnetic fluxes generated by low-voltage coil 21B, and magnetic fluxes Fc1, Fc2 are magnetic fluxes generated by high-voltage coil 21C. Magnetic flux in the stacking direction of the plurality of magnetic sheets generated by a current flowing through the high-voltage coil and magnetic fluxes in the stacking direction of the plurality of magnetic sheets generated by currents flowing through the low-voltage coils strengthen each other. In FIG. 25, the stacking direction of the plurality of magnetic sheets corresponds to the up-down direction in the paper plane.

Eddy current is generated by the leaked magnetic flux in the direction perpendicular to iron core 15E (leg iron core 14). As shown in FIG. 25, in portions of the iron core between the high-voltage coil and the low-voltage coils (portions 35A to 35D indicated by broken lines in FIG. 25), eddy current is generated by the leaked magnetic fluxes from the low-voltage coils and the leaked magnetic flux from the high-voltage coil, resulting in a large eddy current. Accordingly, a particularly large eddy current loss is caused in the portions of the iron core between the high-voltage coil and the low-voltage coils.

According to Embodiment 6, the slits (16A, 16B) are formed in the portions of the iron core in which a particularly large eddy current loss is caused, that is, the portions of the iron core between the high-voltage coil and the low-voltage coils. Thereby, according to Embodiment 6, eddy current can be effectively reduced, and thus eddy current loss can be reduced, as in Embodiments 1 to 5. Therefore, according to Embodiment 6, loss in the transformer can be reduced, as in Embodiments 1 to 5.

Modifications of Embodiment 6

Figure 26:
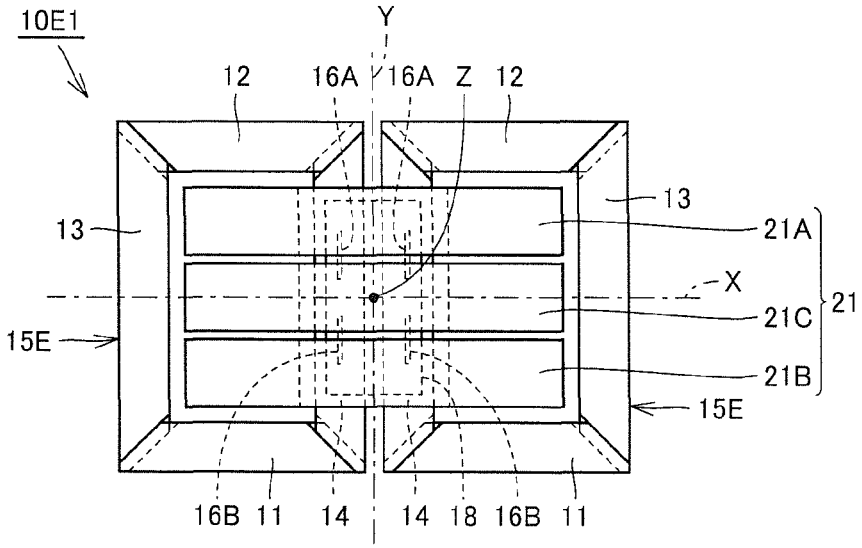
FIG. 26 is a view of a transformer in accordance with a first modification of Embodiment 6 when viewed from a stacking direction of a plurality of magnetic sheets constituting an iron core.
Figure 27:
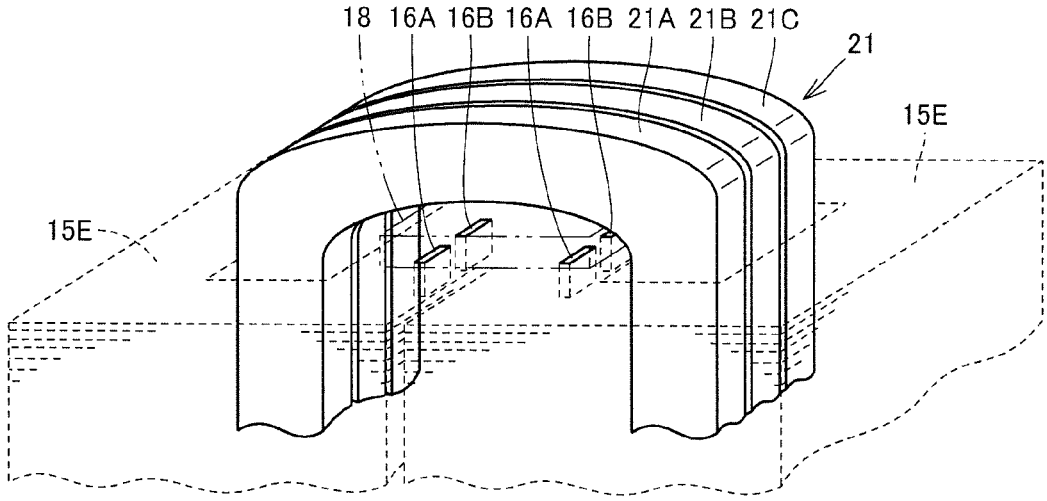
FIG. 27 is a perspective view for illustrating the transformer shown in FIG. 26.
Figure 28:
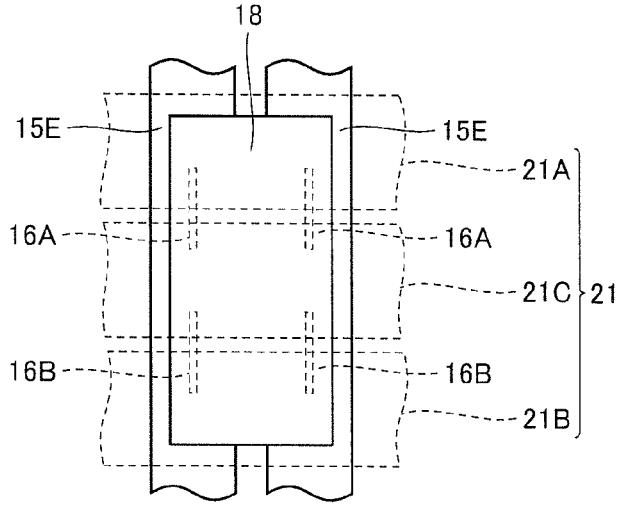
FIG. 28 is a plan view for illustrating an arrangement of an electromagnetic shield and slits in the transformer shown in FIGS. 26 and 27.

FIG. 26 is a view of a transformer in accordance with a first modification of Embodiment 6 when viewed from a stacking direction of a plurality of magnetic sheets constituting an iron core. FIG. 27 is a perspective view for illustrating the transformer shown in FIG. 26. FIG. 28 is a plan view for illustrating an arrangement of an electromagnetic shield and slits in the transformer shown in FIGS. 26 and 27. Referring to FIGS. 26 to 28, transformer 10E1 includes low-voltage coils 21A, 21B, high-voltage coil 21C, iron cores 15E, and electromagnetic shields 18, 19. When viewed from the stacking direction of the plurality of magnetic sheets, slits 16A, 16B are formed in a region overlapped with electromagnetic shield 18.

Figure 29:
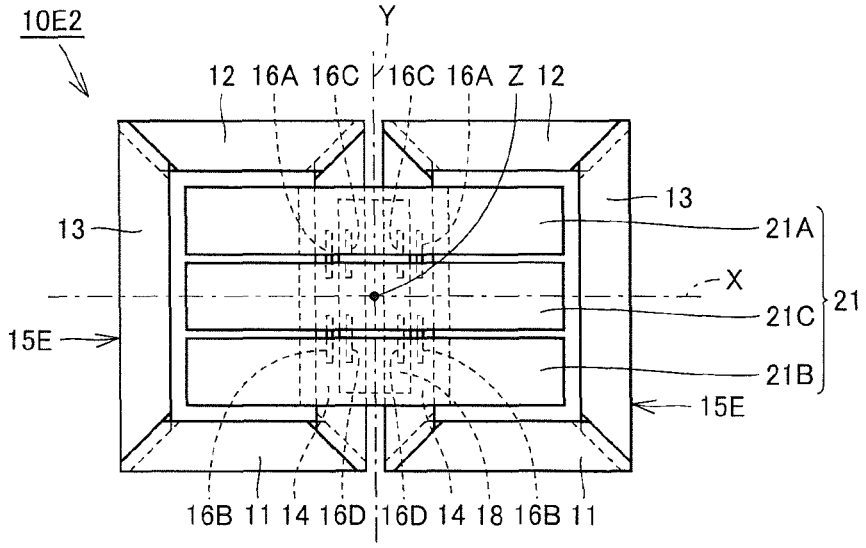
FIG. 29 is a view of a transformer in accordance with a second modification of Embodiment 6 when viewed from a stacking direction of a plurality of magnetic sheets constituting an iron core.

FIG. 29 is a view of a transformer in accordance with a second modification of Embodiment 6 when viewed from a stacking direction of a plurality of magnetic sheets constituting an iron core. Referring to FIG. 29, a transformer 10E2 has iron cores 15E in which slits 16A to 16D are formed. When viewed from the stacking direction of the plurality of magnetic sheets, slits 16A to 16D are formed in regions between the high-voltage coil and the low-voltage coils. Specifically, when viewed from the stacking direction of the plurality of magnetic sheets, slits 16A, 16B are formed in regions which are between the high-voltage coil and the low-voltage coils and not overlapped with electromagnetic shield 18. On the other hand, when viewed from the stacking direction of the plurality of magnetic sheets, slits 16C, 16D are formed in regions which are between the high-voltage coil and the low-voltage coils and overlapped with electromagnetic shield 18.

Figure 30:
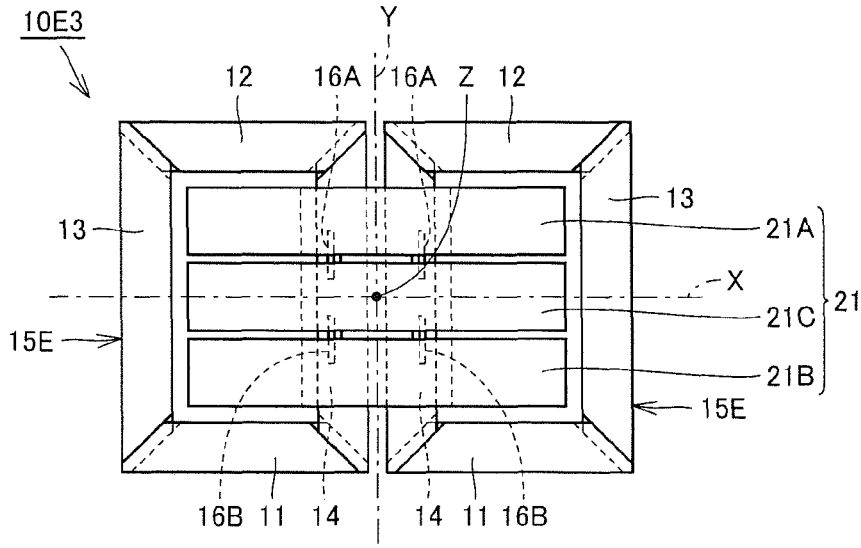
FIG. 30 is a view of a transformer in accordance with a third modification of Embodiment 6 when viewed from a stacking direction of a plurality of magnetic sheets constituting an iron core.

FIG. 30 is a view of a transformer in accordance with a third modification of Embodiment 6 when viewed from a stacking direction of a plurality of magnetic sheets constituting an iron core. Referring to FIG. 30, a transformer 10E3 is different from each of transformers 10E, 10E1, and 10E2 described above in that it does not have electromagnetic shield 18. It is to be noted that, when viewed from the stacking direction of the plurality of magnetic sheets, slits 16A, 16B are formed in regions between the high-voltage coil and the low-voltage coils.

Figure 31:
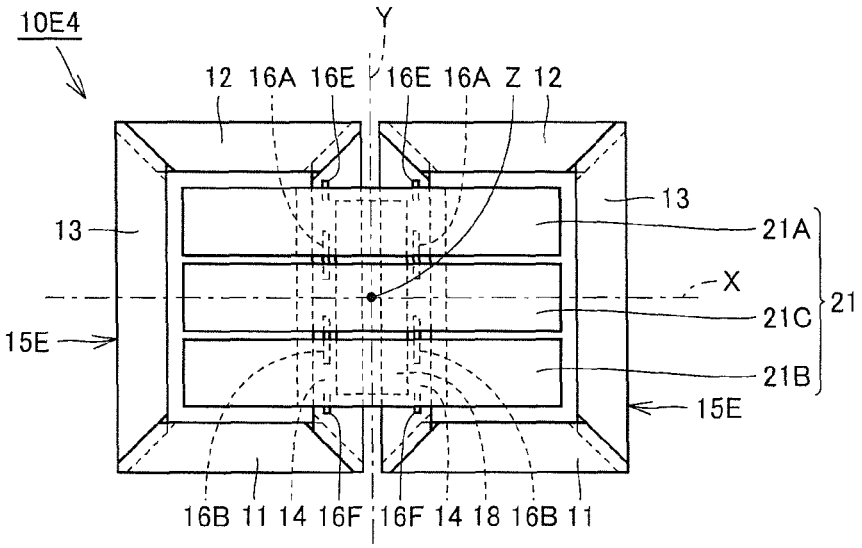
FIG. 31 is a view for illustrating an arrangement of slits in a fourth modification of Embodiment 6.

FIG. 31 is a view for illustrating an arrangement of slits in a fourth modification of Embodiment 6. Referring to FIG. 31, a transformer 10E4 has iron cores 15E (leg iron cores 14) in which slits 16A, 16B, 16E, and 16F are formed. Slits 16A, 16B are formed in the regions between the high-voltage coil and the low-voltage coils. Slits 16E, 16F are respectively formed at both ends of leg iron core 14. When viewed from the stacking direction of the plurality of magnetic sheets, low-voltage coil 21A overlaps a portion of slit 16E. Similarly, when viewed from the stacking direction of the plurality of magnetic sheets, low-voltage coil 21B overlaps a portion of slit 16F.

As shown in FIG. 25, in portions 35E to 35H of iron core 15E corresponding to end portions of leg iron core 14, the leaked magnetic fluxes (Fa1, Fa2, Fb1, Fb2) generated by the low-voltage coils are oriented perpendicular to the surfaces of iron core 15E (leg iron core 14). This is considered as the reason that eddy current is generated in portions 35E to 35H of iron core 15E. According to the configuration shown in FIG. 31, since the slits are formed in portions 35E to 35H of iron core 15E, eddy current generated by the leaked magnetic fluxes from low-voltage coils 21A, 21B can be further reduced.

It is to be noted that electromagnetic shield 18 can be omitted from the configuration shown in FIG. 31. Further, slits 16E, 16F may be additionally formed in the iron core shown in FIG. 26 or the iron core shown in FIG. 29.

Embodiment 7

In Embodiments 1 to 6, a shell-type transformer is shown as a transformer to which the present invention is applicable. However, the present invention is not limited to a shell-type transformer, and is also applicable to a core-type transformer.

Figure 32:
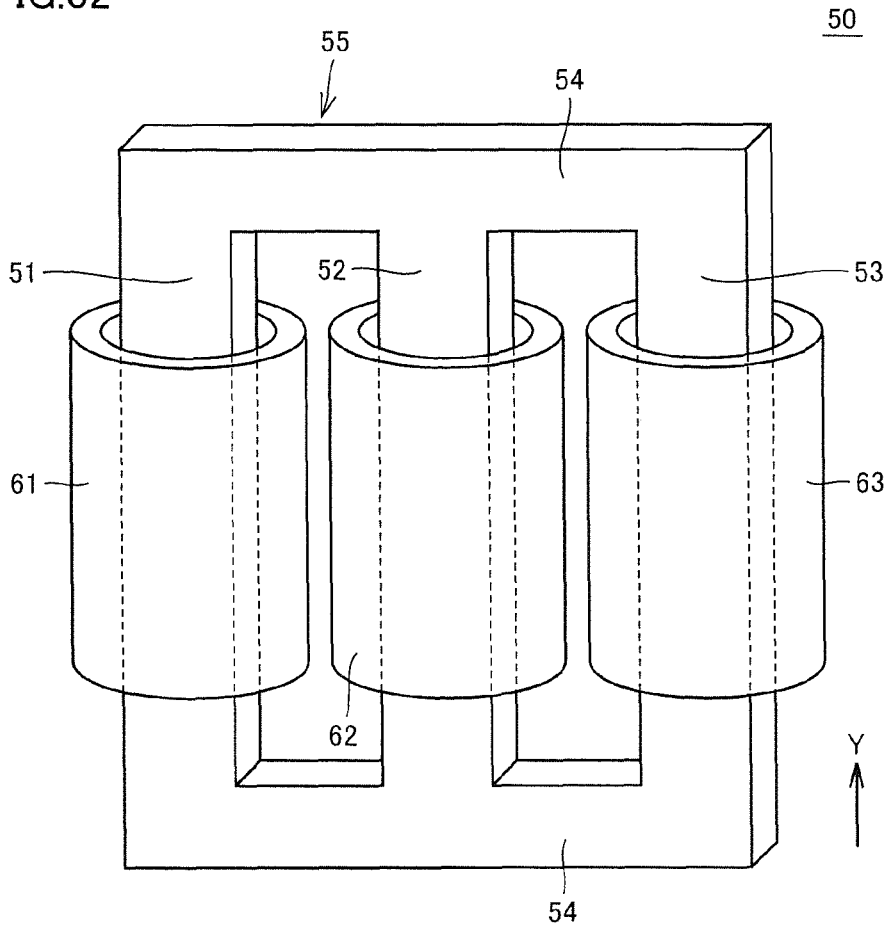
FIG. 32 is a view for schematically illustrating a configuration of a core-type transformer.

FIG. 32 is a view for schematically illustrating a configuration of a core-type transformer. Referring to FIG. 32, a transformer 50 includes iron cores including iron cores 51, 52, and 53, and coils 61, 62, and 63 wound around iron cores 51, 52, and 53, respectively. A Y direction in FIG. 32 indicates a direction of winding axes of coils 61, 62, and 63.

Each of iron cores 51 to 53 described above and the coil wound around the iron core are provided corresponding to each phase of a three-phase alternating current. Since iron cores 51 to 53 have a structure identical to each other, the structure of iron core 51 will be described below as a representative example.

Figure 33:
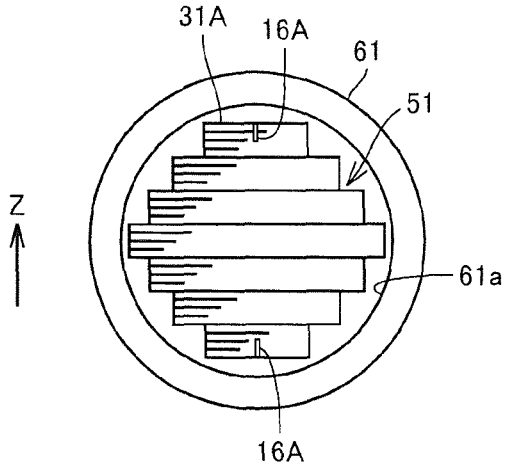
FIG. 33 is a view for illustrating a structure of an iron core 51 in FIG. 32.

FIG. 33 is a view for illustrating the structure of iron core 51 in FIG. 32. Referring to FIG. 33, iron core 51 is composed of a plurality of stacked magnetic sheets (electromagnetic steel sheets 31A). A Z direction in the drawing indicates a stacking direction of electromagnetic steel sheets 31A. In FIG. 33, the direction penetrating the paper plane corresponds to the Y direction shown in FIG. 32.

Slits 16A are formed in at least magnetic sheets facing an inner peripheral surface 61*a* of coil 61, of the plurality of magnetic sheets. Slit 16A may be formed not only in the magnetic sheet facing inner peripheral surface 61*a* of coil 61, but also in magnetic sheets aligned consecutively from the magnetic sheet.

Even when eddy current is generated in iron core 51 by leaked magnetic flux entering iron core 51 from coil 61, the eddy current can be reduced by slits 16A. Therefore, according to Embodiment 7, eddy current loss in the iron core can be reduced in the core-type transformer.

It is to be noted that, in Embodiment 7, one end of the slit may reach an end portion of the magnetic sheet as in Embodiment 2, and positions of slits may be different in the plurality of magnetic sheets as in Embodiment 3.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

REFERENCE SIGNS LIST

10, 10A to 10D, 10E, 10E1 to 10E4, 50: transformer, 11, 12: yoke iron core, 13, 14, 14A, 14B: leg iron core, 15, 15A, 15B, 15E, 51 to 53: iron core, 16, 16A to 16F: slit, 17: main surface, 17*a*: region, 18, 19: electromagnetic shield, 21, 61 to 63: coil, 21*a*, 61*a*: inner peripheral surface, 31, 31A, 31*p*, 31*q*: electromagnetic steel sheet, 32: insulating film, 35A to 35H: portion (iron core), B: arrow, FL1 to FL4, Fa1, Fa2, Fb1, Fb2, Fc1, Fc2: magnetic flux.

The invention claimed is:

1. A transformer, comprising:

an iron core including a plurality of magnetic sheets stacked in one direction;

a coil wound around said iron core such that a winding axis thereof is perpendicular to a stacking direction of said plurality of magnetic sheets; and an electromagnetic shield inserted between an inner peripheral surface of said coil and a magnetic sheet which faces said inner peripheral surface of said coil, wherein, when viewed from said stacking direction of said plurality of magnetic sheets, a slit is formed in a region not overlapped with said electromagnetic shield in a surface of the magnetic sheet which faces said inner peripheral surface of said coil, and a portion of said inner peripheral surface of said coil not overlapping said electromagnetic shield has a curved surface, said iron core includes the magnetic sheet which faces said inner peripheral surface of said coil, said slit is formed in a predetermined number of magnetic sheets aligned consecutively along said stacking direction of said plurality of magnetic sheets, and said slit is formed in said predetermined number of magnetic sheets such that there is no overlap between said slits in two magnetic sheets adjacent in said stacking direction of said plurality of magnetic sheets, of said predetermined number of magnetic sheets.

2. The transformer according to claim 1, wherein, when viewed from said stacking direction of said plurality of magnetic sheets, said coil overlaps one end of said slit, and the other end of said slit reaches an end portion of said magnetic sheet located in an extending direction of said magnetic sheet.

3. The transformer according to claim 1, wherein each of said plurality of magnetic sheets is a directional steel sheet, an extending direction of said magnetic sheet is a rolling direction of said directional steel sheet, and said slit is formed along said rolling direction of said directional steel sheet.

4. The transformer according to claim 1, wherein said coil includes a first coil and a second coil, said first and second coils are configured such that magnetic flux in said stacking direction of said plurality of magnetic sheets generated by a current flowing through said first coil and magnetic flux in said stacking direction of said plurality of magnetic sheets generated by a current flowing through said second coil strengthen each other, and when viewed from said stacking direction of said plurality of magnetic sheets, said slit is formed in at least a region between said first coil and said second coil.

5. The transformer according to claim 1, wherein said iron core includes first and second iron cores aligned in a direction perpendicular to both the stacking direction of said plurality of magnetic sheets and a direction of the winding axis of said coil, and each surrounding the coil, said first iron core includes:

a first leg iron core penetrating said coil;

a second leg iron core arranged outside of said coil to be parallel to said first leg iron core; and first and second yoke iron cores arranged in parallel with an interval interposed therebetween, and connecting said first leg iron core and said second leg iron core, said second iron core includes:

a third leg iron core penetrating said coil and being adjacent to said first leg iron core;

a fourth leg iron core arranged outside of said coil to be parallel to said third leg iron core, and located opposite to said second leg iron core; and third and fourth yoke iron cores arranged in parallel with an interval interposed therebetween, and connecting said third leg iron core and said fourth leg iron core, and when viewed from said stacking direction of said plurality of magnetic sheets, said electromagnetic shield is arranged to overlap said first and third leg iron cores, and said slit is formed in the region not overlapped with said electromagnetic shield in each of said first and third leg iron cores.

6. The transformer according to claim 1, wherein the electromagnetic shield is in contact with the surface of the magnetic sheet which faces said inner peripheral surface of said coil.

7. A transformer, comprising:

an iron core including a plurality of magnetic sheets stacked in one direction;

a coil wound around said iron core such that a winding axis thereof is perpendicular to a stacking direction of said plurality of magnetic sheets; and an electromagnetic shield inserted between an inner peripheral surface of said coil and a magnetic sheet which faces said inner peripheral surface of said coil, wherein, when viewed from said stacking direction of said plurality of magnetic sheets, a slit is formed in a region overlapped with said electromagnetic shield in a surface of the magnetic sheet which faces said inner peripheral surface of said coil.

8. The transformer according to claim 7, wherein said coil includes a first coil and a second coil arranged along a direction perpendicular to said stacking direction of said plurality of magnetic sheets, said first and second coils are configured such that magnetic flux in said stacking direction of said plurality of magnetic sheets generated by a current flowing through said first coil and magnetic flux in said stacking direction of said plurality of magnetic sheets generated by a current flowing through said second coil strengthen each other, and when viewed from said stacking direction of said plurality of magnetic sheets, said slit is formed in at least a region between said first coil and said second coil.

9. The transformer according to claim 7, wherein the electromagnetic shield is in contact with the surface of the magnetic sheet which faces said inner peripheral surface of said coil.

10. A transformer, comprising:

an iron core including a plurality of magnetic sheets stacked in one direction;

a coil wound around said iron core such that a winding axis thereof is perpendicular to a stacking direction of said plurality of magnetic sheets; and an electromagnetic shield inserted between an inner peripheral surface of said coil and a magnetic sheet which faces said inner peripheral surface of said coil, wherein, when viewed from said stacking direction of said plurality of magnetic sheets, a slit is formed in a region overlapped with said electromagnetic shield in a surface of the magnetic sheet which faces said inner peripheral surface of said coil, a slit is formed in a region not overlapped with said electromagnetic shield in the surface of the magnetic sheet which faces said inner peripheral surface of said coil, and a portion of said inner peripheral surface of said coil not overlapping said electromagnetic shield has a curved surface.

11. The transformer according to claim 10, wherein the electromagnetic shield is in contact with the surface of the magnetic sheet which faces said inner peripheral surface of said coil.

* * * * *